US009550090B2

(12) United States Patent
Dibenedetto et al.

(10) Patent No.: US 9,550,090 B2
(45) Date of Patent: Jan. 24, 2017

(54) PORTABLE FITNESS MONITORING SYSTEMS WITH DISPLAYS AND APPLICATIONS THEREOF

(71) Applicant: adidas AG, Herzogenaurach (DE)

(72) Inventors: Christian Dibenedetto, Portland, OR (US); Mark Arthur Oleson, Portland, OR (US); Scott Tomlinson, Portland, OR (US)

(73) Assignee: addidas AG, Herzogenaurach (DE)

( * ) Notice: Subject to any disclaimer, the term of this patent is extended or adjusted under 35 U.S.C. 154(b) by 42 days.

(21) Appl. No.: 14/278,639

(22) Filed: May 15, 2014

(65) Prior Publication Data

US 2014/0249661 A1 Sep. 4, 2014

Related U.S. Application Data

(60) Division of application No. 13/743,037, filed on Jan. 16, 2013, now Pat. No. 8,801,577, which is a (Continued)

(51) Int. Cl.
*A63B 24/00* (2006.01)
*A63B 71/06* (2006.01)

(52) U.S. Cl.
CPC ..... *A63B 24/0062* (2013.01); *A63B 71/0622* (2013.01); *A63B 71/0686* (2013.01); (Continued)

(58) Field of Classification Search
CPC . A63B 24/00; A63B 24/0062; A63B 71/0622; A63B 71/0686; A63B 2071/0661; A63B 2071/0663; A63B 2225/20; A63B 2225/50;A63B 2230/04; A63B 2230/06; A63B 2024/0065; Y10S 48/901; A44D 2203/00
See application file for complete search history.

(56) References Cited

U.S. PATENT DOCUMENTS 3,742,937 A 7/1973 Manuel et al.
3,802,698 A 4/1974 Burian et al.
(Continued)

FOREIGN PATENT DOCUMENTS

EP 1195135 B1 4/2002
EP 2025369 A2 2/2009
(Continued)

OTHER PUBLICATIONS

Notice of Allowance mailed Sep. 27, 2012 in U.S. Appl. No. 13/328,425 to Oleson et al., filed Dec. 16, 2011.
(Continued)

*Primary Examiner* — Glenn Richman
(74) *Attorney, Agent, or Firm* — Sterne, Kessler, Goldstein & Fox P.L.L.C.

(57) ABSTRACT

Portable fitness monitoring systems with displays, and applications thereof, are disclosed. In an embodiment, a method of providing performance feedback to an individual using a portable fitness monitoring device is provided. The method may include sensing performance parameter information during the physical activity, generating a first visual output that includes an indication of the intensity level that the individual should be performing at, and generating a second visual output that includes an indication of the intensity level that the individual is currently performing at.

27 Claims, 11 Drawing Sheets

Related U.S. Application Data continuation of application No. 13/328,425, filed on Dec. 16, 2011, now Pat. No. 8,360,936, which is a continuation of application No. 12/467,948, filed on May 18, 2009, now Pat. No. 8,105,208.

(52) U.S. Cl.
CPC .. *A44D 2203/00* (2013.01); *A63B 2024/0065* (2013.01); *A63B 2071/0661* (2013.01); *A63B 2071/0663* (2013.01); *A63B 2225/20* (2013.01); *A63B 2225/50* (2013.01); *A63B 2230/04* (2013.01); *A63B 2230/06* (2013.01); *Y10S 482/901* (2013.01)

(56) References Cited

U.S. PATENT DOCUMENTS 3,838,684 A 10/1974 Manuel et al.
3,978,849 A 9/1976 Geneen
4,027,663 A 6/1977 Fischler et al.
4,038,976 A 8/1977 Hardy et al.
4,120,294 A 10/1978 Wolfe
4,120,296 A 10/1978 Prinz
4,221,223 A 9/1980 Linden
4,248,244 A 2/1981 Charnitski et al.
4,252,128 A 2/1981 Kane
4,364,556 A 12/1982 Otte
4,436,096 A 3/1984 Dyck et al.
4,647,217 A 3/1987 Havel
4,653,498 A 3/1987 New, Jr. et al.
4,776,323 A 10/1988 Spector
4,788,983 A 12/1988 Brink et al.
4,938,228 A 7/1990 Righter et al.
5,314,389 A 5/1994 Dotan
5,686,938 A 11/1997 Batkhan
5,697,791 A 12/1997 Nashner et al.
5,735,799 A 4/1998 Baba et al.
5,769,755 A 6/1998 Henry et al.
5,857,939 A 1/1999 Kaufman
5,891,042 A 4/1999 Sham et al.
5,976,083 A 11/1999 Richardson et al.
6,002,982 A 12/1999 Fry
6,013,007 A 1/2000 Root et al.
6,080,110 A 6/2000 Thorgersen
6,080,111 A 6/2000 Pao-Lang
6,104,947 A 8/2000 Heikkila et al.
6,133,722 A 10/2000 Havel
6,135,951 A 10/2000 Richardson et al.
6,148,262 A 11/2000 Fry
6,163,718 A 12/2000 Fabrizio
6,230,047 B1 5/2001 McHugh
6,244,988 B1 6/2001 Delman
6,251,048 B1 6/2001 Kaufman
6,345,197 B1 2/2002 Fabrizio
6,394,960 B1 5/2002 Shinogi et al.
6,463,385 B1 10/2002 Fry
6,572,636 B1 6/2003 Hagen et al.
6,582,342 B2 6/2003 Kaufman
6,585,622 B1 7/2003 Shum et al.
6,607,493 B2 8/2003 Song
6,716,139 B1 4/2004 Hosseinzadeh-Dolkhani et al.
6,734,837 B1 5/2004 Havel
6,736,759 B1 5/2004 Stubbs et al.
6,745,069 B2 6/2004 Nissila et al.
6,749,432 B2 6/2004 French et al.
6,753,882 B2 6/2004 Nakazawa et al.
6,758,816 B1 7/2004 Tsubata et al.
6,798,378 B1 9/2004 Walters
6,823,036 B1 11/2004 Chen
6,832,109 B2 12/2004 Nissila
6,837,827 B1 1/2005 Lee et al.
6,853,955 B1 2/2005 Burrell et al.
6,882,955 B1 4/2005 Ohlenbusch et al.
7,057,551 B1 6/2006 Vogt
7,062,225 B2 6/2006 White
7,076,291 B2 7/2006 Pulkkinen et al.
7,085,678 B1 8/2006 Burrell et al.
7,097,588 B2 8/2006 Watterson et al.
7,192,387 B2 3/2007 Mendel
7,192,402 B2 3/2007 Amano et al.
7,220,220 B2 5/2007 Stubbs et al.
7,229,385 B2 6/2007 Freeman et al.
7,251,454 B2 7/2007 White
7,254,516 B2 8/2007 Case, Jr. et al.
7,292,867 B2 11/2007 Werner et al.
7,383,081 B2 6/2008 Butt et al.
7,398,151 B1 7/2008 Burrell et al.
7,480,512 B2 1/2009 Graham et al.
7,518,054 B2 4/2009 McKinney et al.
7,519,327 B2 4/2009 White
7,603,255 B2 10/2009 Case, Jr. et al.
7,648,463 B1 1/2010 Elhag et al.
7,670,263 B2 3/2010 Ellis et al.
7,758,469 B2 * 7/2010 Dyer et al. ..... 482/4
7,766,794 B2 8/2010 Oliver et al.
7,771,320 B2 8/2010 Riley et al.
7,927,253 B2 4/2011 Vincent et al.
8,001,472 B2 8/2011 Gilley et al.
8,033,959 B2 10/2011 Oleson et al.
8,103,517 B2 1/2012 Hinnebusch
8,105,208 B2 1/2012 Oleson et al.
8,121,785 B2 2/2012 Swisher et al.
8,360,936 B2 1/2013 DiBenedetto et al.
8,529,407 B2 9/2013 Nurmela et al.
2001/0003542 A1 6/2001 Kita
2002/0068873 A1 6/2002 Nissila
2003/0028116 A1 2/2003 Bimbaum
2003/0069108 A1 4/2003 Kaiserman et al.
2003/0171189 A1 9/2003 Kaufman
2003/0224337 A1 12/2003 Shum et al.
2004/0046692 A1 3/2004 Robson et al.
2004/0102931 A1 5/2004 Ellis et al.
2004/0116784 A1 6/2004 Gavish
2004/0171956 A1 9/2004 Babashan
2004/0199056 A1 10/2004 Husemann et al.
2005/0049113 A1 3/2005 Yueh et al.
2005/0124463 A1 6/2005 Yeo et al.
2005/0181347 A1 8/2005 Barnes et al.
2005/0195094 A1 9/2005 White
2005/0197063 A1 9/2005 White
2005/0256416 A1 11/2005 Chen
2005/0266961 A1 12/2005 Shum et al.
2006/0136173 A1 6/2006 Case, Jr. et al.
2006/0169125 A1 8/2006 Ashkenazi et al.
2006/0189360 A1 8/2006 White
2006/0253210 A1 11/2006 Rosenberg
2007/0006489 A1 1/2007 Case, Jr. et al.
2007/0011919 A1 1/2007 Case, Jr.
2007/0021269 A1 1/2007 Shum
2007/0033069 A1 2/2007 Rao et al.
2007/0159926 A1 7/2007 Prstojevich et al.
2007/0232455 A1 * 10/2007 Hanoun ..... 482/8
2007/0260421 A1 11/2007 Berner, Jr. et al.
2008/0002528 A1 1/2008 Andren et al.
2008/0004510 A1 1/2008 Tanzawa et al.
2008/0009275 A1 1/2008 Werner et al.
2008/0051993 A1 2/2008 Graham et al.
2008/0058971 A1 3/2008 Graham et al.
2008/0059064 A1 3/2008 Werner et al.
2008/0065319 A1 3/2008 Graham et al.
2008/0096726 A1 4/2008 Riley et al.
2008/0101161 A1 5/2008 Imai et al.
2008/0103689 A1 5/2008 Graham et al.
2008/0171636 A1 7/2008 Usui et al.
2008/0200310 A1 8/2008 Tagliabue
2008/0319661 A1 12/2008 Werner et al.
2009/0047645 A1 2/2009 Dibenedetto et al.
2009/0048044 A1 2/2009 Oleson et al.
2009/0048070 A1 2/2009 Vincent et al.
2009/0233769 A1 * 9/2009 Pryor ..... 482/8
2009/0233770 A1 9/2009 Vincent et al.

(56) References Cited

U.S. PATENT DOCUMENTS

| | | | | |
|---|---|---|---|---|
| 2010/0056341 | A1* | 3/2010 | Ellis et al. | 482/9 |
| 2010/0075806 | A1 | 3/2010 | Montgomery | |
| 2010/0292600 | A1 | 11/2010 | Dibenedetto et al. | |

FOREIGN PATENT DOCUMENTS

| | | | |
|---|---|---|---|
| JP | H11-118953 | | 4/1999 |
| JP | 2001-235560 | | 8/2001 |
| JP | 2002-369709 | A | 12/2002 |
| JP | 3094882 | U | 4/2003 |
| JP | 2009-050699 | A | 3/2009 |
| WO | WO 02/067449 | A2 | 8/2002 |
| WO | WO 2008/101168 | A2 | 8/2008 |
| WO | WO 2009/033034 | A1 | 3/2009 |

OTHER PUBLICATIONS

Non-Final Office Action mailed Jun. 7, 2012 in U.S. Appl. No. 13/328,425 to Oleson et al., filed Dec. 16, 2011.

Notice of Allowance mailed Sep. 29, 2011 in U.S. Appl. No. 12/467,948 to Oleson et al., filed May 18, 2009.

Non-Final Office Action mailed May 9, 2011 in U.S. Appl. No. 12/467,948 to Oleson et al., filed May 18, 2009.

Office Action issued in Japanese Appl. No. 2012-182227, dated Dec. 2, 2014.

* cited by examiner

| ZONE | COLOR | % OF MAX HR |
|---|---|---|
| ENERGY | BLUE | 65–75% |
| ENDURANCE | GREEN | 75–85% |
| STRENGTH | YELLOW | 85–90% |
| POWER | RED | 90–95% |
FIG. 11
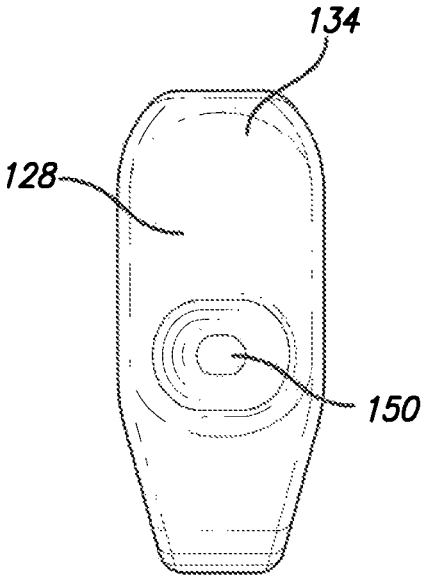
FIG. 12A
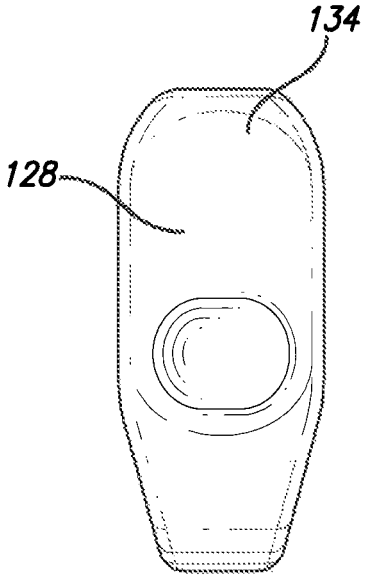
FIG. 12B

PORTABLE FITNESS MONITORING SYSTEMS WITH DISPLAYS AND APPLICATIONS THEREOF

CROSS-REFERENCE TO RELATED APPLICATIONS

The present application is a divisional of U.S. patent application Ser. No. 13/743,037, filed Jan. 16, 2013, which is a continuation of U.S. patent application Ser. No. 13/328,425, filed Dec. 16, 2011, now U.S. Pat. No. 8,360,936, which is a continuation of U.S. patent application Ser. No. 12/467,948, filed May 18, 2009, now U.S. Pat. No. 8,105,208, each of which is incorporated herein by reference in its entirety.

This application is also related to commonly owned U.S. patent application Ser. No. 12/467,944, filed May 18, 2009, now U.S. Pat. No. 8,033,959, and commonly owned U.S. patent application Ser. No. 12/468,025, filed May 18, 2009, now U.S. Pat. No. 8,200,323, each of which is incorporated herein by reference in its entirety.

FIELD OF THE INVENTION

The present invention generally relates to fitness monitoring systems. More particularly, the present invention relates to portable fitness monitoring systems with displays, and methods of providing performance feedback using a portable fitness monitoring device.

BACKGROUND OF THE INVENTION

Exercise is important to maintaining a healthy lifestyle and individual well-being. Accordingly, many individuals want to participate in an exercise program. The most successful exercise programs may be ones tailored to a fitness level of an individual and aimed at assisting the individual to achieve one or more specific fitness or exercise goals. Information about the individual's progress toward achieving their goals may be collected using sensors for measuring various physical and/or physiological parameters associated with the individual's physical activity.

Amateur and professional athletes alike have begun paying greater attention to specific heart rates (i.e. heart beats per minute) achieved during exercise, as recommended by their trainers and other programs. While in some cases it may not be critical that the exercising individual establish a precise heart rate, the individual may want to maintain their heart rate within desired ranges throughout their physical activity to achieve specific fitness goals. Technology has resulted in the development of portable heart rate monitors that can detect the individual's heart rate and provide a variety of outputs indicative thereof.

What is needed are new portable fitness monitoring systems that have displays with improved aesthetics and functionalities that enable the individual to exercise at intensities appropriate for their current fitness level and goals.

BRIEF SUMMARY OF THE INVENTION

In at least one embodiment, a method of providing performance feedback to an individual using a portable fitness monitoring device includes sensing performance parameter information during the physical activity, generating a first visual output that includes an indication of the intensity level that the individual should be performing at, and generating a second visual output that includes an indication of the intensity level that the individual is currently performing at.

In another embodiment, a method includes sensing performance parameter information during the physical activity, generating a first output that includes an indication of the intensity level that the individual should be performing at, and generating a second output that includes an indication of the intensity level that the individual is currently performing at.

In another embodiment, a method includes sensing performance parameter information during the physical activity, generating a first visual output that includes an indication of the intensity level that the individual should be performing at, generating a second visual output that includes an indication of the intensity level that the individual is currently performing at, and changing the second visual output in response to a change in the intensity level that the individual is currently performing at.

Further embodiments, features, and advantages of the present invention, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate the present invention by way of example, and not by way of limitation, and, together with the description, further serve to explain the principles of the invention and to enable a person skilled in the pertinent art to make and use the invention.

FIG. 11 is table that illustrates heart rate zone ranges according to an embodiment of the present invention.

FIG. 12A is an illustration of a combined display module and strap according to an embodiment of the present invention.

FIG. 12B is an illustration of a combined display module and strap according to an embodiment of the present invention.

DETAILED DESCRIPTION OF THE INVENTION

The present invention will now be described in detail with reference to embodiments thereof as illustrated in the accompanying drawings. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Figure 1:
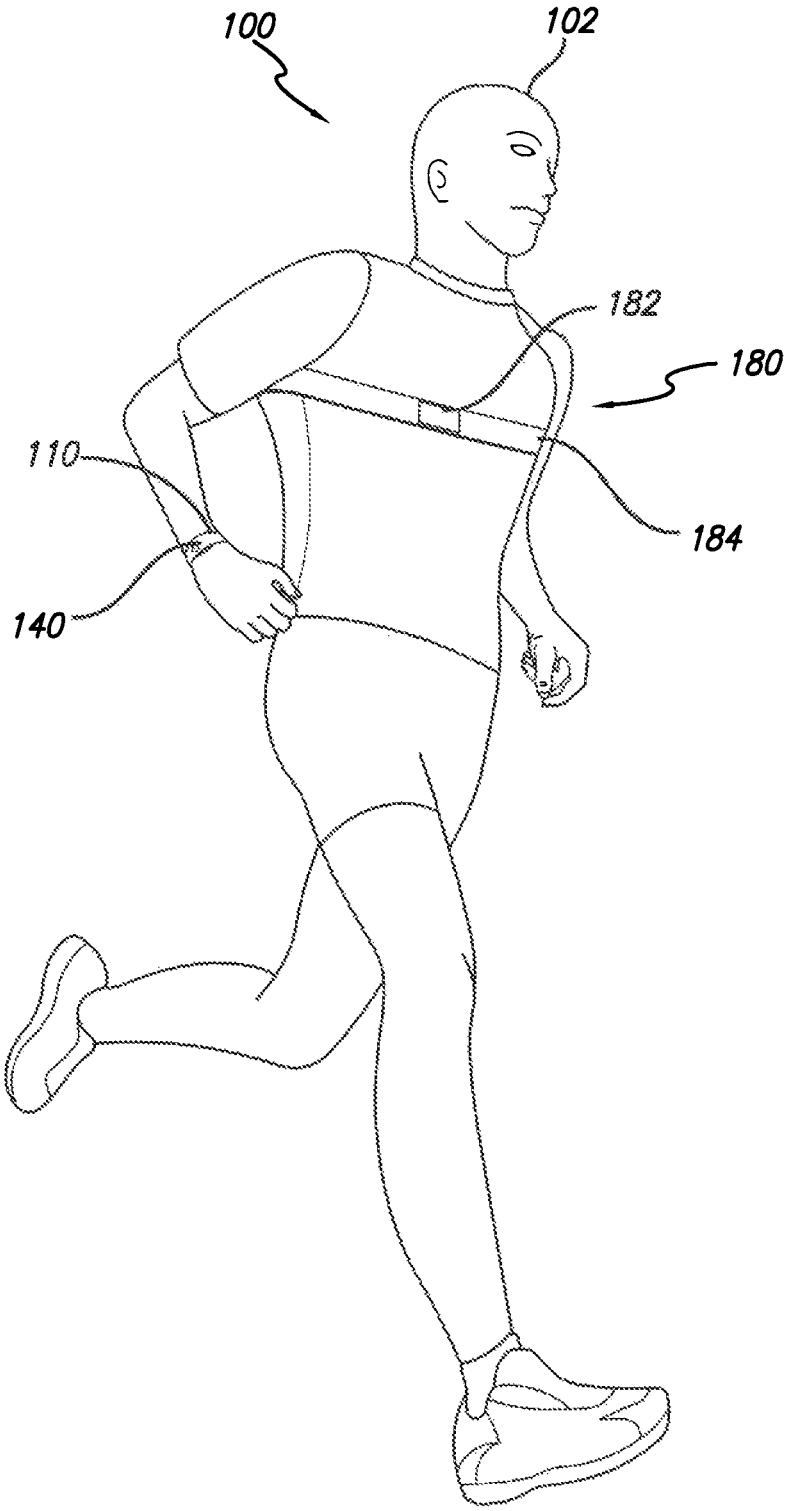
FIG. 1 is an illustration of an athlete using a portable fitness monitoring system according to an embodiment of the present invention.

FIG. 1 is a diagram of an athlete 102 using a portable fitness monitoring system 100 according to an embodiment of the present invention. The fitness monitoring system 100 may be used to provide performance feedback to an athlete 102. In one embodiment, the performance feedback may be provided by displaying to the athlete an indication of one or more performance zones based on one or more performance parameters associated with the athlete's 102 physical activity.

As depicted in FIG. 1, in one embodiment, the monitoring system 100 includes an article for wearing 110, a display module 140, and a sensor 180. The article for wearing 110 may be releasably secured to the body of the athlete 102, and the display module 140 may be releasably secured to the article for wearing 110. The display module 140 and the sensor 180 may communicate over a wireless communications network. In one embodiment, the display module 140 and the sensor 180 may communicate using a low-power wireless communications protocol and form part of a wireless personal area network (WPAN). For example, the components of the monitoring system 100 may communicate over a network using one or more of the following protocols: ANT, ANT+Sport by Dynastream Innovations, Bluetooth Low Energy Technology, Zigbee, Simplicity or BlueRobin. Other known communication protocols suitable for a fitness monitoring system may be used.

The portable fitness monitoring system 100 is shown being used by an athlete 102 while running. In addition to being used by runners, the monitoring system 100 can be used by individuals engaged in a variety of physical activities including, but not limited to, walking, biking, skating, swimming, skiing, performing aerobic exercises, weight lifting, or participating in various individual or team sports. Accordingly, terms such as, for example, "athlete," "runner," "exercising individual," and "user" may be referred to herein interchangeably.

The sensor 180 measures one or more performance parameters associated with the athlete's 102 physical activity, and communicates data relating to the performance parameters to the display module 140. The term "performance parameters" may include physical parameters and/or physiological parameters associated with the athlete's 102 physical activity. Physical parameters measured may include, but are not limited to, for example, time, distance, speed, pace, pedal count, wheel rotation count, stride count, stride length, stride rate, altitude, strain, and/or impact force. Physiological parameters measured may include, but are not limited to, for example, heart rate, heart rate variability, blood oxygen level, blood flow, hydration level, respiration rate, calories burned, and/or body temperature. The sensor 180 typically acts as a WPAN transmitter.

The sensor 180 depicted in FIG. 1 is a heart rate sensor 182. Heart rate sensor 182 may be used to determine the heart rate of the athlete 102. In an embodiment, the heart rate sensor 182 may be integrally and fixedly incorporated into or releasably attached to clothing worn by athlete 102. In another embodiment, the heart rate sensor 182 may be integrally and fixedly incorporated into or releasably attached to a chest strap 184 worn by the athlete 102.

While the accompanying description is primarily directed towards embodiments wherein the sensor 180 is a heart rate sensor 182, those skilled in the art will readily recognize that a variety of performance parameter sensors 180 may be used in place of, or in conjunction with, the heart rate sensor 182, including, but not limited to, an accelerometer, a pedometer, a pulsimeter, a thermometer, an altimeter, a pressure sensor, a strain gage, a bicycle power meter, a bicycle crank or wheel position sensor, or other sensor for detecting a user performance parameter.

In one embodiment of the present invention, the display module 140 may act as a WPAN receiver. It may receive data from other components of the portable fitness monitoring system 100, such as the heart rate sensor 182, and it may provide performance feedback to the athlete 102. In an embodiment, feedback is provided to the athlete 102 using a display. As discussed in further detail below, the feedback may be provided through one or more visual, audible, and/or sensory means. In one embodiment, the display module 140 also acts as a transmitter and transmits data and information to other components within and/or outside of the monitoring system 100.

Figure 2:
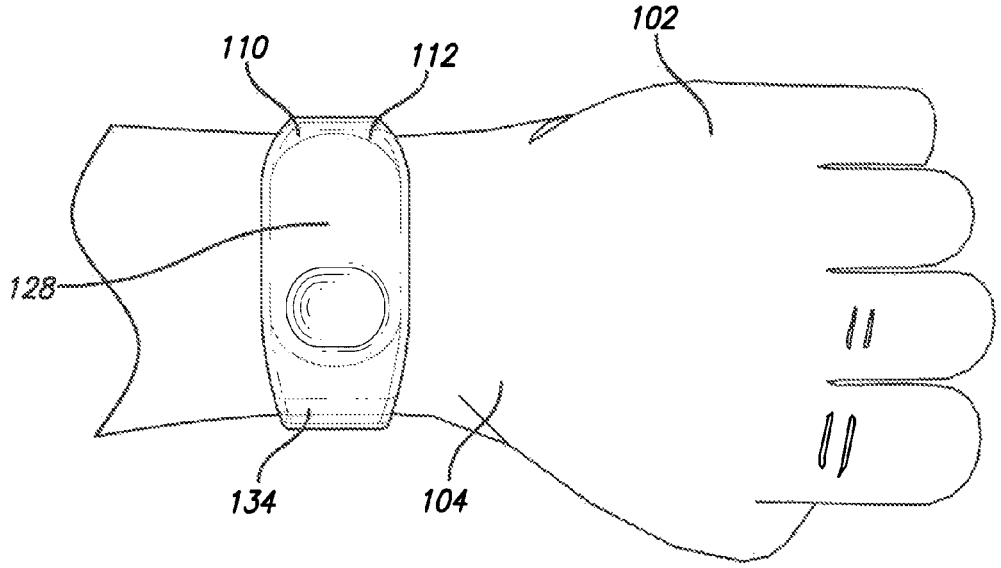
FIG. 2 is an illustration of a strap attached to the wrist of an athlete according to an embodiment of the present invention.

The article for wearing 110 may be releasably secured to the body of the athlete 102, and the display module 140 may be releasably secured to the article for wearing 110. In an alternative embodiment, the display 140 module may be permanently fixed to or integrally formed with the article for wearing 110. With reference to FIGS. 1 and 2, the article for wearing 110 is depicted as a strap 112 releasably secured to the wrist 104 of the athlete 102. In alternative embodiments of the present invention, the article for wearing 110 may include, but is not limited to, for example, a band, a glove, a hat, a jacket, a shirt, a pair of pants, a sports bra, an article of footwear, a piece of eyewear, a ring, or any other article capable of being worn by an athlete 102. In some embodiments, article for wearing 110 may be an article of clothing with a sensor 180 incorporated therein. In some embodiments, the display module 140, the article for wearing 110, and the sensor 180 may all be integrally connected. In other embodiments, the display module 140, the article for wearing 110, and the sensor 180 may be physically separate, discrete components.

In one embodiment, the physically separate, discrete display module 140, article for wearing 110, and sensor 180, may be releasably connected and in wired communication with one another. For example, an article for wearing 110 may be a jacket or other piece of outerwear including one or more wires fixed to, incorporated into, and/or passing through at least one layer of the jacket. The one or more wires may terminate with connector ports at portions of the jacket that are accessible to the athlete 102. The athlete may then attach the display module 140 and sensor 180 to the connector ports thus enabling wired communication between the display module 140, article for wearing 110, and sensor 180.

In other embodiments, the article for wearing 110 can be secured somewhere else on the athlete's 102 body such as, for example, on the athlete's forearm, finger, head, chest, hip, or foot. Portions of the article for wearing 110 that are closer to the part of the body of the user 102 than the article for wearing 110 is secured to may be referred to herein as the "inner" 132 portions of the article of wearing 110, while portions that are further from the part of the body of the user 102 than the article for wearing 110 is secured to may be referred to herein as the "outer" 134 portions.

Figure 3A:
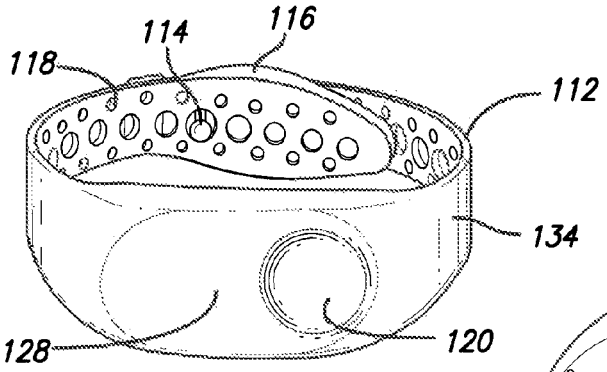
FIG. 3A is a front elevational view of a strap according to an embodiment of the present invention.
Figure 3B:
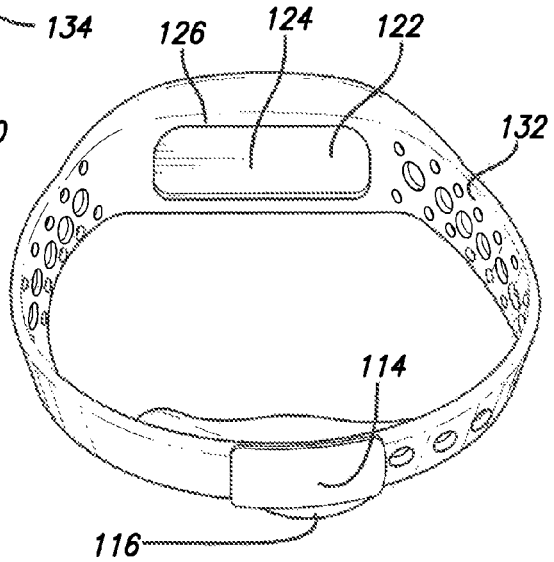
FIG. 3B is a rear elevational view of a strap according to an embodiment of the present invention.

FIGS. 3A and 3B are illustrations of an article for wearing 110 in the form of a strap 112 according to one embodiment of the present invention. The strap 112 is adapted to be releasably secured to the wrist 104 of an exercising individual 102. The strap 112 may be flexible to fit around the user's 102 wrist 104, and may have a central portion between first and second end portions. In one embodiment, the strap 112 may be molded out of a flexible polymeric material, such as, for example, polyurethane. Other materials, including, but not limited to, rubber, plastic, TPU, cloth, leather, PU, silicon, metal, and/or other suitably flexible materials may be used. In one embodiment, the strap 112 may be injection molded. Flexible straps 112 may be formed from inflexible materials such as, for example, a plurality of small metal rings or pieces linked together to form a mesh-like strap. More traditional metallic straps such as those commonly employed in wrist watches that are comprised of a series of interconnected members may also be employed. Other suitable manufacturing techniques may be used.

The strap 112 may include fastening means 114 for releasably securing the strap 112 around the wrist 104. In one embodiment, a fastener 114 may have one or more male and female components for securing the strap 112 around the wrist 104. The components of the fastener 114 may be injection molded and integrally formed with the strap 112, or they may be separate components. Multiple female components may be provided along the length of strap 112 so that the strap 112 is adaptable to varying wrist 104 sizes. One or more male components may be provided to engage with one or more of the female components. The strap 112 may additionally include ridges 116 to keep any overlapping first and second end portions of the strap 112 in a relatively parallel configuration. The inner surface 132 of the strap 112 may include dimples and/or protuberances 118 or other surface characteristics to limit relative motion between the inner surface 132 of the strap 112 and the athlete's 102 wrist 104.

Other fastening means 114 may be used to releasably secure the strap 112 around the wrist 104, including, but not limited to, hook and loop fasteners (e.g., VELCRO®), snaps, buttons, buckles, clasps, magnets, or other suitable means. Generally speaking, any known fastening means including, but not limited to, those commonly used to secure a wristwatch to a wearer's wrist may be used. In one embodiment, the strap 112 may not include fastening means 114. In this embodiment, the strap may be made of a suitably elastic material such that the strap 112 may remain releasably secured around the wrist 104 without fastening means. In another embodiment, the strap 112 may be a continuous loop lacking first and second ends. The continuous loop strap 112 may be made of a suitably elastic material such that the strap 112 may stretch to pass over the athlete's 102 hand and thereafter contract to remain releasably secured around the athlete's 102 wrist 104.

The strap 112 may be configured such that the display module 140 may be releasably secured to the strap 112. As shown in FIG. 3B, the strap 112 includes a cavity 122 defined therein. The display module 140 may be secured within the cavity 122. The cavity 122 may have an opening 124. The opening 124 may be large enough that the display module 140 may be inserted into the cavity 122 through the opening 124. In one embodiment, the opening 124 may be located on an inner surface 132 of the strap 112. In other embodiments, the opening 124 may be located on an outer surface 134 of the strap or a side surface of the strap. In an embodiment, multiple openings may be provided so that the display module 140 could be inserted into the strap 112 from a variety of different entry points.

The display module 140 may be releasably secured within the cavity 122 of the strap 112 by any means known in the art including, but not limited to, snaps, clips, magnets, or adhesives. In one embodiment, the display module 140 is frictionally secured within the cavity 122. When the strap 112 is made of a sufficiently flexible material, such as certain injection molded polymeric materials, the cavity 122 of the strap may be capable of releasably securing the display module 140 without the assistance of snaps, clips, magnets, adhesives, or the like. The ability of the cavity 122 to releasably secure the display module 140 may optionally be enhanced by contouring the interior surfaces of the cavity 122 to the corresponding exterior surfaces of the display module 140, by fabricating the strap 112 cavity 122 out of a resilient material capable of elastic deformation, and/or by providing a lip 126 around an edge of the opening 124, as illustrated in FIG. 3B.

In one embodiment, the display module 140 is adapted to provide a visual output that is visible through the strap 112. The visual output may be visible through a portion of the strap 112 surrounding the cavity 122. In one embodiment, as shown in FIGS. 3A and 3B, an outer surface 134 of the strap 112 may include a window 128. The window 128 and other portions of the outer surface 134 may present a homogeneous surface. "Homogeneous," as used herein, means that the window 128 and outer surface 134 of the strap 112 have substantially consistent characteristics over the substantial entirety of their surfaces. For example, the outer surface 134 including the window 128 in the embodiment shown in FIGS. 2 and 3A has visually consistent characteristics and texturally consistent characteristics over the substantial entirety of the outer surface 134.

In an embodiment, at least a portion of the window 128 may be separable from the rest of the strap 112. For example, the window 128 may be entirely removable from the strap 112, or the window 128 may be fixedly attached to the strap 112 but may be capable of "opening" by rolling up, folding back, sliding back, or otherwise exposing the cavity 122 underlying the window 128.

In one embodiment, as shown in FIG. 3A, where the window 128 is not separable from the strap 112, the window 128 of the outer surface 134 of the strap 112 may have a depression 120. As described in further detail below, the depression 120 may indicate a portion of the window 128 that may be touched, depressed, or otherwise interacted with by the user 102 to actuate an input control 160. In an embodiment, the depression 120 is relatively smooth and shallow so as not so disrupt the aesthetically uniform nature of the outer surface 134.

In one embodiment, all or a substantial portion of the strap 112, including the outer surface 134 and the window 128, is made of a single, integrally formed piece of material. This single piece of material may be a flexible polymeric material, such as polyurethane or other suitable materials, as discussed above.

The display module 140 may include a display for providing a visual output. In one embodiment, the visual output is responsive to heart rate data received from the heart rate sensor 182. The display may include multiple sub-displays capable of displaying different types of information or displaying the same information in different ways, as described in further detail below.

In embodiments of the present invention, the display module 140 may be adapted to provide non-visual output, including, but not limited to, audible output and other sensory output. For example, the display module 140 may include a speaker for providing audible output to the athlete 102. The display module 140 may include means for vibrating the module 140, such as, for example, a piezoelectric actuator, for providing sensory output to the athlete 102.

Figure 4A:
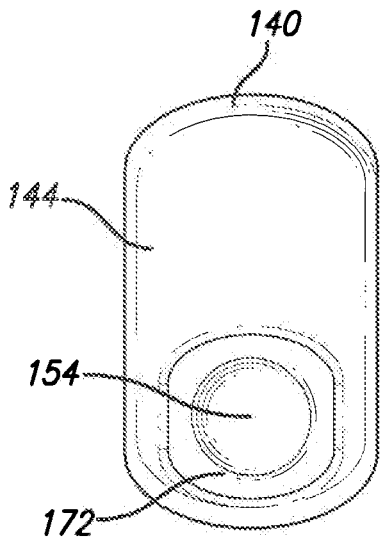
FIG. 4A is a plan view of a display module according to an embodiment of the present invention.
Figure 4B:
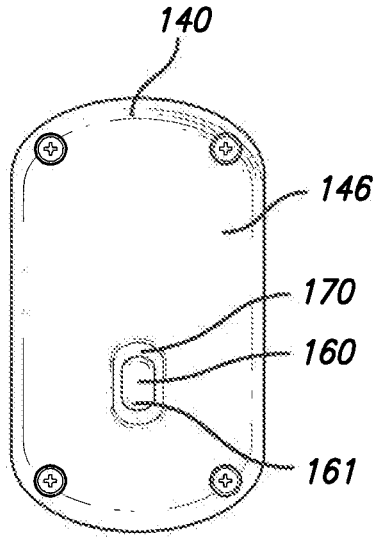
FIG. 4B is a bottom side view of a display module according to an embodiment of the present invention.

In one embodiment of the present invention, as shown in FIGS. 4A and 4B, the display module 140 may be a pod including a housing having top 144 and bottom 146 surfaces, respectively. As used herein, "top surface" refers to a surface of the display module 140 that is furthest from the part of the body of the user 102 that the article for wearing 110 (or strap 112) is secured to, while "bottom surface" refers to a surface of the display module 140 that is closest to the part of the body of the user 102 that the article for wearing 110 (or strap 112) is secured to. In one embodiment, the display module 140 housing (including top 144 and bottom 146 surfaces) may be made of plastic, such as, for example, TPU, nylon, glass-filled nylon, or polycarbonate. Other materials suitable for the display module may be used.

Figure 5A:
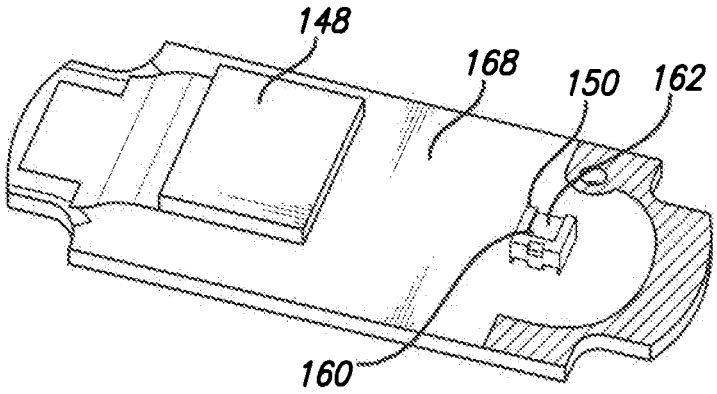
FIG. 5A is a top perspective view of a portion of a display module according to an embodiment of the present invention.
Figure 5B:
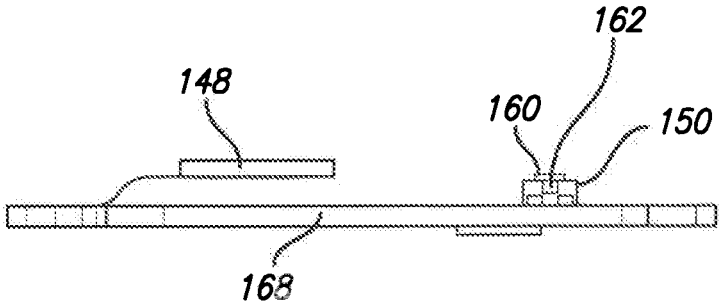
FIG. 5B is a side view of a portion of a display module according to an embodiment of the present invention.

As shown in FIGS. 5A and 5B, the display module 140 may include a circuit board 168 for supporting the necessary electrical components of the device, as will be appreciated by those of skill in the art. The circuit board 168 may include visual display means. In one embodiment, the visual display means includes a first display 148 and a second display 150. The first display 148 may be capable of displaying alphanumerical information, while the second display 150 may be capable of displaying information based on the color and/or blink rate of one or more light emitting sources, such as light emitting diodes (LEDs). The circuit board 168, including first display 148 and a second display 150, may be contained within the display module 140 housing between the top 144 and bottom 146 surfaces.

In one embodiment, the visual display means, such as the first display 148 and the second display 150, may be supported by another surface besides the circuit board.

The display module 140 may include one or more input controls 160, such as, for example, buttons, dials, touch sensors, or switches, for manually interacting with the device. In an embodiment, the input controls may be voice-activated controls. The input controls 160 may be used, for example, to influence at least one characteristic of the visual output. In one embodiment, as shown in FIG. 4B, an input control 160 may be a bottom button 161 located on a bottom surface 146 of the display module 140. The bottom button 161 may be provided in a recess 170 formed in the bottom surface 146 such that the bottom button 161 is flush with the bottom surface 146 and is thus protected from being inadvertently manipulated when the bottom surface 146 makes contact with another surface, e.g., the user's 102 wrist 104.

Figure 6A:
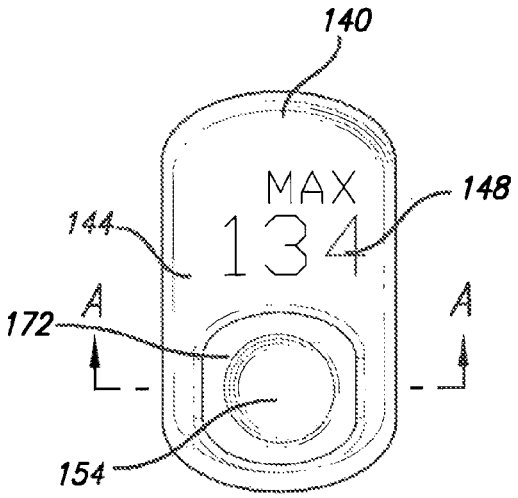
FIG. 6A is a plan view of a display module according to an embodiment of the present invention.
Figure 6B:
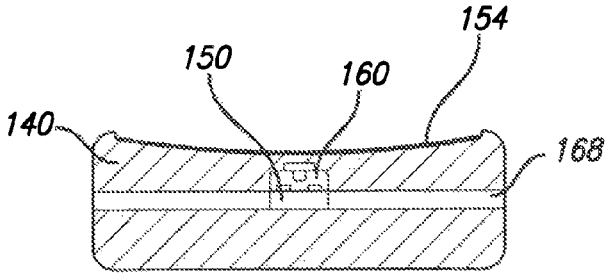
FIG. 6B is a front sectional view of the display module of FIG. 6A taken at the sectional plane A-A in FIG. 6A according to an embodiment of the present invention.

In one embodiment, as shown in FIGS. 5A, 5B, and 6B, an input control 160 may be a top button 162 coupled to the circuit board 168. The top button 162 may be aligned with an aperture 172 formed in the top surface 144 of the display module. As shown in FIGS. 4A, 6A, and 6B, a flexible casing 154 may span the aperture 172 covering the top button 162. Accordingly, the flexible casing 154 may be depressed by the user 102 to actuate the top button 162. In one embodiment, the flexible casing 154 is made of a flexible polymeric material. In another embodiment, the aperture 172 and casing 154 are not present and the top surface 144 is a continuous surface that is flexible enough that it may be depressed to actuate the top button 162.

As shown in FIGS. 5A and 5B, the circuit board 168 may include a first display 148. The first display 148 may be an alphanumerical display capable of displaying both letters and numbers. In one embodiment, the first display 148 comprises a flexible LED substrate, such as those sold by Avago Technologies of San Jose, Calif. In one embodiment of the present invention, the first display 148 may include one or more seven-segment displays. In another embodiment of the present invention, the first display 148 may include one or more dot-matrix displays. The first display 148 may utilize LED, liquid crystal display (LCD), organic light emitting diode (OLED), or any other light-generating or light-controlling technologies known in the art.

The first display 148 may be positioned just below the top surface 144 of the display module 140 housing. As illustrated by FIG. 6A, if the top surface 144 is sufficiently translucent or transparent, when the first display 148 is activated, visible light may be emitted and transmitted through the top surface 144.

The first display 148 is adapted to display a numerical value based on performance parameter data received from the sensor 180. In one embodiment, the first display 148 may display a numerical heart rate value based on heart rate data received from the heart rate sensor 182. In other embodiments, the first display 148 may display a value associated with another user performance parameter, including, but not limited to, time, distance, speed, pace, pedal count, wheel rotation count, stride count, stride length, stride rate, altitude, strain, impact force, respiration rate, calories burned, and/or body temperature.

As shown in FIGS. 5A, 5B and 6B, the circuit board 168 may include a second display 150. The second display 150 may be capable of displaying information based on the color and/or blink rate of one or more light emitting sources, such as one or more single or multi-color LEDs. The second display may also have a casing 154. In one embodiment, as shown in FIGS. 4A, 6A, and 6B, the casing 154 above the light emitting source may be the same casing 154 as the casing 154 that spans the aperture 172 covering the top button 162 (or any other input control 160), such that the casing 154 may be depressed by the user to actuate the top button 162, as described in further detail below. In embodiments where the top surface 144 is continuous and sufficiently flexible, the top surface 144 may be depressed instead, as described above.

The second display may include a one ore more single or multi-color LEDs contained beneath the casing 154. When the semiconductor diode of an LED is forward biased (i.e. turned on), visible light may be emitted by the LED and transmitted through the casing 154. In an embodiment, the casing 154 is transparent. In another embodiment, the casing 154 is translucent. The casing 154 may be of such translucent character that light from the one or more LEDs may be able to pass through it, but the physical components of the top input button 162 and/or the second display 150 itself may not viewable through the casing 154. The color of the light emitted by the one of more LEDs is determined by the energy gap of the semiconductor. Methods of activating and deactivating LEDs and of producing different colors of light from single and/or multi-color LEDs are well known in the art and will not be described in further detail herein. In an embodiment, the one or more LEDs are bottom-emitting LEDs.

Figure 8:
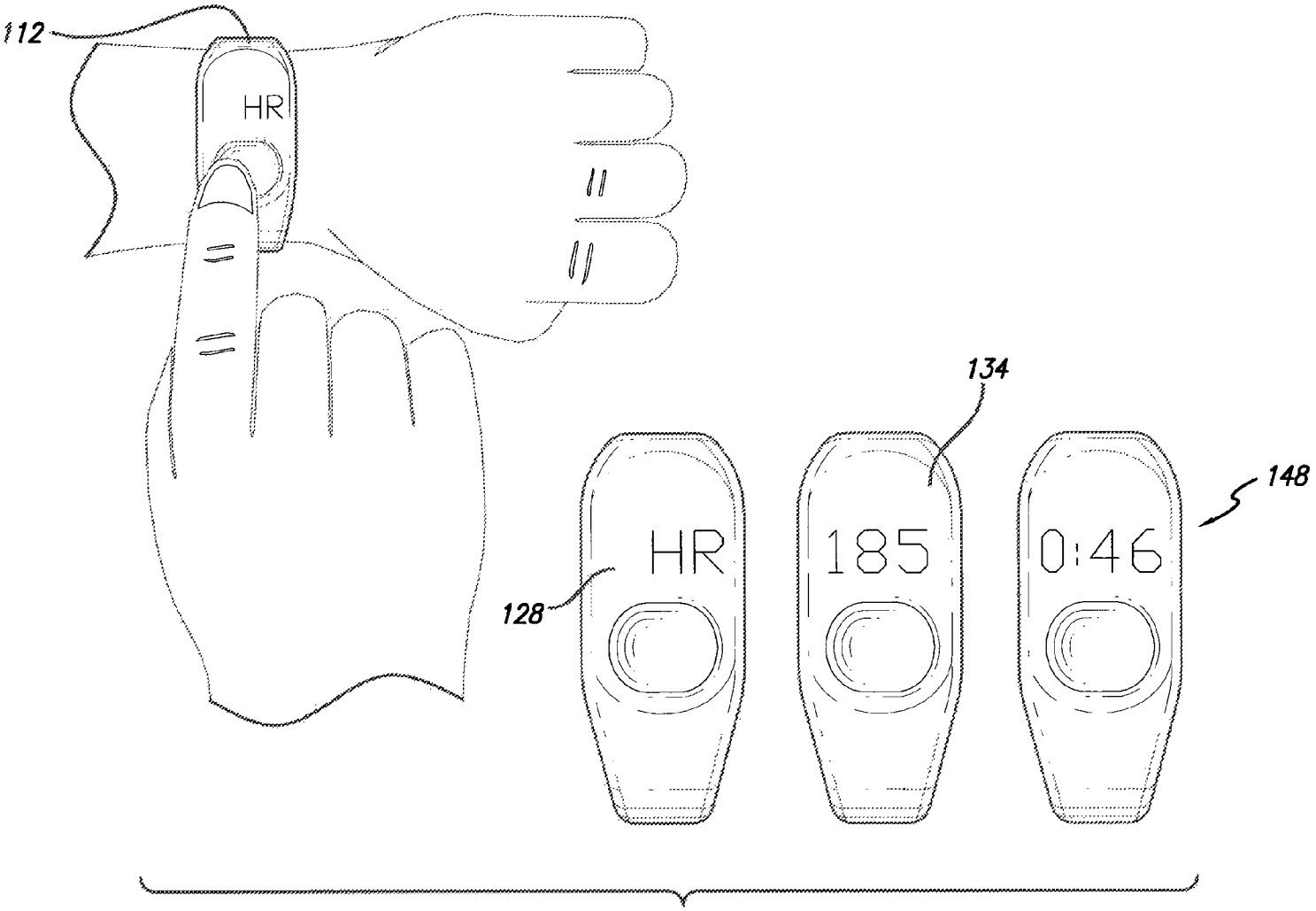
FIG. 8 is a diagram of combined display modules and straps according to an embodiment of the present invention.

In one embodiment of the present invention, the casing 154 that spans the aperture 172 covering the top button 162 may be depressed by the user to actuate the top button 162. The user 102 may, for example, activate the top button 162 by physically pushing the casing 154 downward in the direction of the bottom surface 146 of the display module 140. In another embodiment, the casing 154 and an electrically conductive input control 160 may be capable of functioning as a capacitance, touch, and/or proximity sensor. In this embodiment, the user 102 could activate the input control 160 by simply touching the casing 154 with their finger. The functioning of capacitance switches is well known to those of skill in the art. FIG. 8 illustrates an athlete 102 activating an input control 160 (which may or may not be the top button 162) through the casing 154 in one embodiment.

The second display 150 may be capable of displaying information based on the color and/or blink rate of one or more light emitting sources, such as LEDs, that are based on performance parameter data including data received from a sensor 180. In one embodiment, the light emitting sources of the second display 150 may blink at a rate that is based on heart rate data received from the heart rate sensor 182. In another embodiment, the light emitting sources of the second display 150 may emit a colored light, the color of which is responsive to the heart rate data received from the heart rate sensor 182. The user 102 may activate the top button 162 by physically pushing the casing 154 of the second display 150 downward in the direction of the bottom surface 146 of the display module 140. In this manner, the user 102 may have the unique experience of activating and/or manipulating one or both of the displays 148 and/or 150 by applying pressure to an area of the top surface 144 of the display module 140 underneath which the second display 150 and the top button 152 are located.

Figure 7:
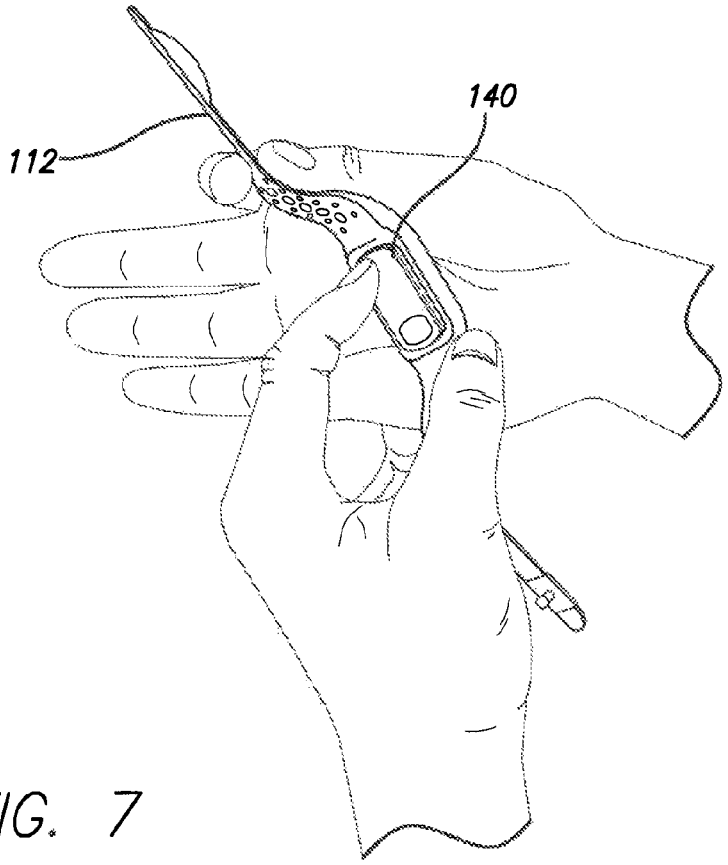
FIG. 7 is an illustration of a display module and a strap according to an embodiment of the present invention.

With reference to FIG. 7, in one embodiment of the present invention, the display module 140 may be inserted into the cavity 122 of the strap 112 prior to use. As shown in FIG. 7, in one exemplary embodiment, while the strap 112 is free from the wrist 104 of the athlete 102, the athlete 102 first places the display module 140 adjacent to the opening 124 of the cavity 122. The opening 124 of the cavity 122 is on the inner surface 132 of the strap 112, and the display module 140 is configured such that the top surface 144 of the display module is facing the opening 124. Next, the athlete manipulates the display module 140 and the strap 112 so that the display module 140 is urged into the interior of the cavity 122, where it is releasably held in position. The athlete may similarly manipulate the combined display module-strap structure (140 and 112) if the athlete desires to remove the display module 140 from the strap 112. Manipulation may involve pulling, pushing, or otherwise applying force with one's hands to the display module 140 and the strap 112 such that the two become releasably combined or physically separated, as desired by the athlete 102.

In one embodiment, the exterior of the display module 140 and the cavity 122 of the strap 112 are complementarily contoured such that these elements can join together with little or no space between their respective surfaces. In another embodiment, the cavity 122, opening 124, lip 126, and window 128 regions of the strap 112 are made from an elastically deformable material so as to aid in receiving and releasing the display module 140. In a further embodiment, the display module 140 itself includes elements that are elastically deformable so as to aid in entering and leaving the cavity 122.

When the display module 140 and the strap 112 are combined, the window 128 of the strap 112 may cover the entire top surface 144 of the display module 140, including the aperture 172 and the casing 154. Alternatively, the window 128 may cover only one or both of the regions of the top surface 144 immediately adjacent to the underlying first and second displays 148 and 150.

As further illustrated in FIG. 8, the depression 120 may be immediately on top of and aligned with the casing 154 spanning the aperture 172 of the top surface 144 of the display module 144. Thus, the depression 120 may also aligned with the top button 162. Accordingly, the user 102 may activate and/or manipulate one or both of the displays 148 and 150 by applying pressure to the depression 120 which transmits the force to the casing 154 of the display module 140 underneath which the second display 150 and the top button 152 may be located. Activation and/or manipulation may occur when the pressure is transmitted to and received by the top button 152.

As shown in the embodiment of FIG. 8, once the display module 140 has been inserted into the strap 112, the display module is capable of providing a visual output that is visible through the window 128 of the strap 112. While light provided by the displays 148 and 150 may always be able to shine through the window when the displays 148 and 150 are activated, depending on the properties of the material used to form the window 128, all, some, or none of the top surface 144 of the display module 140, including the aperture 172 and the casing 154, may be visible to the athlete through the window 128.

In one embodiment, the top surface 144 of the display module 140, including the aperture 172 and the casing 154, may not be viewable through the window 128 of the strap 112. In this embodiment, the window 128 may include a translucent surface. When the displays 148 and 150 are in an inactive state, the top surface 144 of the display module 140, including the aperture 172 and the casing 154, may not be viewable through the window 128 because the window 128 may cover and obscure them with the translucent surface that may allow relatively little light to pass through. When the displays 148 and 150 are in an active state, while the light emitted from the active displays 148 and 150 may be viewable through the translucent window 128, the top surface 144 of the display module 140, including the aperture 172 and the casing 154, may not be.

In another embodiment, the top surface 144 of the display module 140, including the aperture 172 and the casing 154, may always be viewable through the window 128 of the strap. Regardless of whether the displays 148 and 150 are in an active or an inactive state, the top surface 144 of the display module 140, including the aperture 172 and the casing 154, may be viewable through the window 128 because, although the window may cover them, the window may be made of either a transparent material or a translucent material that may allow a relatively high amount of light to pass through, including ambient light from the external environment.

In other embodiments, the window 128 may have different regions with different light transmitting properties. For example, when paired with a display module 140 having first and second displays 148 and 150, window 128 could have an obscuring translucent region covering only one or both of the regions of the top surface 144 immediately adjacent to the underlying first and second displays 148 and 150.

In an embodiment, as described above, at least a portion of the window 128 may be separable from the rest of the strap 112. For example, the window 128 may be entirely removable from the strap 112, or the window 128 may be fixedly attached to the strap 112 but may be capable of "opening" by rolling up, folding back, sliding back, or otherwise exposing the cavity 122 underlying the window 128. Any openings made by the window 128 may be aligned with one or both of the regions of the top surface 144 immediately adjacent to the underlying first and second displays 148 and 150. In an embodiment, no window 128 is present and at least a top surface 144 of the display module 140 is exposed.

All, substantially all, or part of the strap 112, including the window 128, may be made of a single flexible material. In one embodiment, while the strap 112 may appear to be generally opaque along most of its length, the window 128 of the strap 112 may be a thinned portion that is sufficiently thin to allow some of the light from the displays 148 and 150 to be viewable when one or more of them are in an active state.

In one embodiment, because the strap 112 and the display module 140 are discrete components, a user may interchange multiple straps 112 without having to replace the display module 140. The user may interchange a strap 112 with a strap 112 having a different size, shape, color, or design, for example, without changing the display module 140. For example, the user may change the strap 112 to color coordinate with a uniform or outfit that the user is wearing. The strap 112 may also be adapted to display the colors or logo of the user's 102 favorite team. In this manner, the strap 112 may be marketed as a fashion article.

In a further embodiment, an article for wearing 110 may be comprised of a central unit including the cavity 122 for receiving the display module 140 and several peripheral units releasably attached to the central unit. For example, a strap 112 may include a central unit including the cavity 122 for receiving the display module 140, and first and second arms releasably attached to the central unit. The first and second arms may have fastening means 114 at their ends, as described in further detail above, for connecting to each other, thus forming a complete strap when connected to the central unit. In this embodiment, the user 102 may interchange multiple first arms, second arms, and central units, without having to replace the display module 140. Thus, as described above, the user 102 may interchange multiple pieces having different sizes, shapes, colors, or designs, for example, without changing the display module 140, thus allowing the pieces to be combined into customizable fashion articles.

In one embodiment, the visual output of the display module 140 transmitted through the strap 112 is responsive to heart rate data received from the heart rate sensor 182. In one embodiment, the first display 148 may display a numerical heart rate value based on heart rate data received from the heart rate sensor 182, and the second display 150 may be capable of displaying heart rate data based on the color and/or blink rate of the one or more LEDs.

The heart rate sensor 182 may be any of a number of known heart rate sensing devices, such as, for example, those sold by Garmin, Suunto, or Oregon Scientific. The heart rate sensor 182 detects heart rate data from the athlete 102. In an embodiment, the heart rate sensor 182 may be integrally incorporated into or releasably attached to a chest strap 184 worn by the athlete 102. The heart rate sensor 182 may wirelessly transmit heart rate data to the display module 140, where it is received by a heart rate receiver 166.

In one embodiment, the heart rate sensor 182 wirelessly transmits one radio pulse for each detected heart event (e.g. a heart beat). In another embodiment, the heart rate sensor 182 wirelessly transmits a uniquely coded data signal that prevents the user's 102 display module 140 from receiving data from other nearby heart rate sensors 182 not associated with the user 102. Transmission may occur in real-time, at predetermined regular intervals, on demand, or after the physical activity is complete.

In one embodiment of the present invention, the display module 140 may not record and log performance data in memory for later use. In other words, the heart rate or other performance parameter data may be used for real-time feedback, but are not recorded after they are used for this purpose. Also, while the display module 140 may include integrally formed visual displays 148 and 150, in one embodiment, it may not provide a transmitter for transmitting data to other portable display devices, and may not provide audio output of any kind. Furthermore, the display module 140 may not communicate data with remote external elements such as a computer 200 or a server 202. This embodiment may advantageously provide reduced size, weight, complexity, and cost as compared to other embodiments.

In another embodiment of the present invention, the display module 140 may record and log performance data in memory for later use. The display module 140 may receive performance parameter data and record performance parameter data, and may transmit performance parameter data to a personal computer 200 and/or a server 202, as described in further detail below, for permanently storing and/or analyzing the performance data.

In a further embodiment, the display module 140 may provide a transmitter for transmitting data to other portable display devices, and may provide audio output, either through integrally formed audio output devices or portable audio output devices. Audio output may include audio performance feedback and/or music, as disclosed in commonly owned U.S. patent application Ser. No. 12/467,944, filed May 18, 2009, now U.S. Pat. No. 8,033,959, the disclosure of which is incorporated herein in its entirety by reference thereto.

In another embodiment, the display module 140 may communicate data with remote external elements such as a computer 200 or a server 202, as disclosed in commonly owned U.S. patent application Ser. No. 12/468,025, filed May 18, 2009, now published as U.S. Patent App. Pub. No. 2010/0292600, the disclosure of which is incorporated herein in its entirety by reference thereto.

Figure 9:
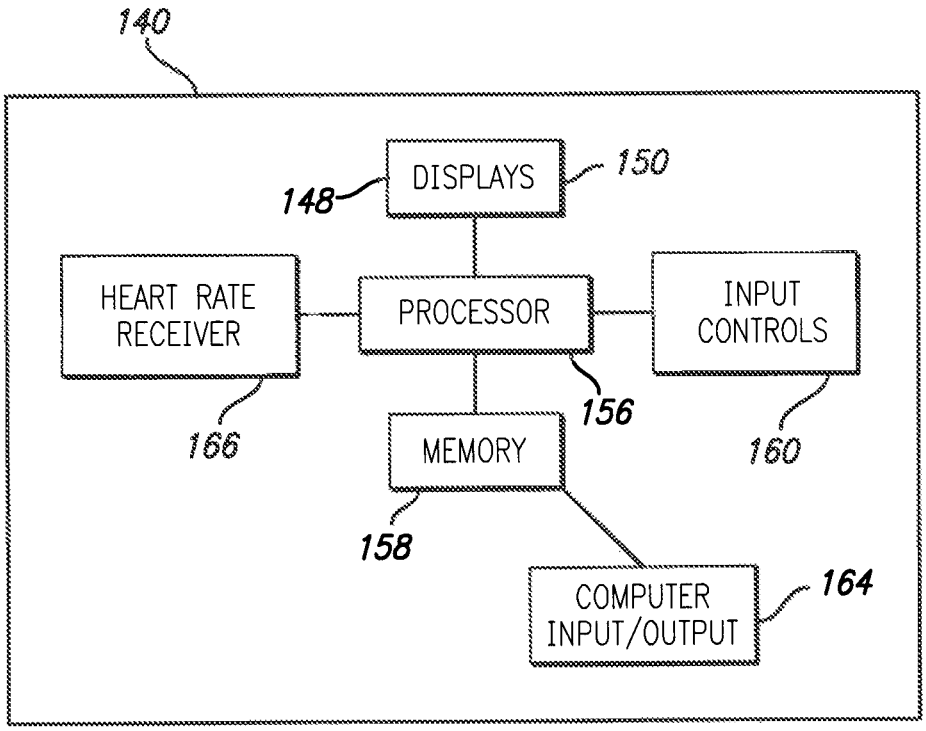
FIG. 9 is a block diagram of components of a display module according to an embodiment of the present invention.

As shown in FIG. 9, in one embodiment, the display module 140 may include a processor 156, a memory 158, one or more input controls 160, a heart rate receiver 166, one or more displays 148 and 150, and a computer input/output 164. The display module 140 may be capable of receiving and processing heart rate data from the heart rate sensor 182 and generating a visual output via one or more displays 148 and 150. The display module 140 may also include a power source, such as a battery.

In embodiments where the display module is capable of interacting with other sensors, other sensor receivers may also be present. For example, in an embodiment, the display module 140 may include an accelerometer receiver capable of communicating with an accelerometer.

The processor 156 may be capable of implementing application programs stored in the memory 158. The processor 156 may also be capable of implementing analog or digital data signal processing algorithms. The processor 156 may be coupled to the memory 158, the input controls 160, the heart rate receiver 166, the displays 148 and 150, and the computer input/output 164. In one embodiment, the processor 156 is model number CY8C21634 made by Cypress Semiconductor of San Jose, Calif.

The memory 158 may be used, for example to store application program instructions and to save recorded performance parameter data. In an embodiment, the memory 158 may store application programs, for example, used to implement aspects of the functionality of the portable fitness monitoring system 100 described further herein. In an embodiment, the memory 158 may include both read only memory and random access memory.

The user input controls 160 may be used by the athlete 102 to interact with the display module 140. In an embodiment, the user input controls 160 may include one or more input buttons, dials, touch sensors, switches, and/or keys. The function of each of these buttons, switches, and/or keys is typically determined based on an operating mode of the display module 140. In one embodiment, the user input controls 160 include a touch pad or scroll pad and/or touch screen buttons. In another embodiment, the user input controls 160 may be voice-activated controls, such as the RSC-4128 speech recognition microcontroller sold by Sensory, Inc. of Sunnyvale, Calif.

In one embodiment, the heart rate receiver 166 may be a low-power receiver used to communicate with the heart rate sensor 182 of the portable fitness monitoring system 100. In an embodiment, the heart rate receiver 166 may operate in an unlicensed frequency band such as 2.4 GHz. The heart rate receiver 166 may be coupled to an antenna. The heart receiver 166 may also be a transceiver capable of bidirectional communication with the heart rate sensor 182.

The computer input/output 164 may be any input/output device or transceiver capable of wired or wireless communication with a personal computer 200 and/or a server 202, as described in further detail below.

Figure 10:
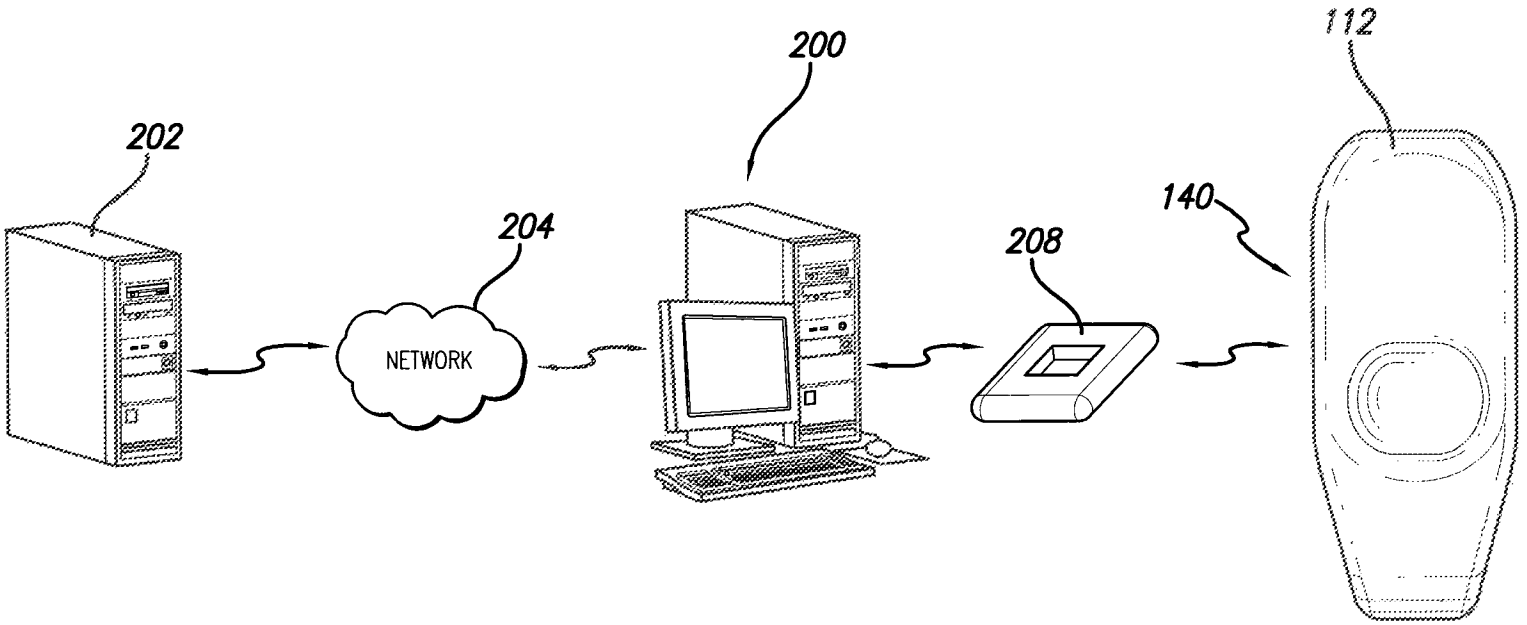
FIG. 10 is an illustration of a display module interacting with a computer and/or a server according to an embodiment of the present invention.

In one embodiment, as shown in FIG. 10, the display module 140 may communicate with a personal computer 200 using wired or wireless communications. Wired communication between the display module 140 and the personal computer 200 may be achieved, for example, by placing the display module 140 in a docking unit 208 that is attached to the personal computer 200 using a communications wire plugged into a communications port of the personal computer 200. In another embodiment, wired communication between the display module 140 and the personal computer 200 may be achieved, for example, by connecting a cable between the display module 140 and the computer 200. The computer input/output 164 of the display module 140 and a communications port of the computer 200 may include USB ports. The cable connecting the display module 140 and the computer 200 may be a USB cable with suitable USB plugs including, but not limited to, USB-A or USB-B regular, mini, or micro plugs.

Wireless communication between the display module 140 and the personal computer 200 may be achieved, for example, by way of a wireless wide area network (WWAN—such as, for example, the Internet), a wireless local area network (WLAN), or a wireless personal area network (WPAN) (collectively, wireless area networks or WANs). As is well known to those skilled in the art, there are a number of known standard and proprietary protocols that are suitable for implementing WANs (e.g. TCP/IP, ANT, ANT+Sport, Zigbee, Bluetooth Low Energy Technology, IEEE 802.16, and Bluetooth). Accordingly, the present invention is not limited to using any particular protocol to communicate between the display module 140 and the various elements of the fitness monitoring system 100 of the present invention.

In one embodiment, the display module 140 may communicate with a WWAN communications system such as that employed by mobile telephones. For example, a WWAN communication system may include a plurality of geographically distributed communication towers and base station systems. Communication towers may include one or more antennae supporting long range two-way radio frequency communication wireless devices, such as the display module 140. The radio frequency communication between antennae and the display module 140 may utilize radio frequency signals conforming to any known or future developed wireless protocol, for example, CDMA, GSM, EDGE, 3G, IEEE 802.x (e.g., IEEE 802.16 (WiMAX)), etc. The information transmitted over-the-air by the base station systems and the cellular communication towers to the display module 140 may be further transmitted to or received from one or more additional circuit-switched or packet-switched communication networks, including, for example, the Internet.

As shown in FIG. 10, communication may also occur between the personal computer 200 and a server 602 via a network 204. In an embodiment, the network 204 is the Internet. The Internet is a worldwide collection of servers, routers, switches and transmission lines that employ the Internet Protocol (TCP/IP) to communicate data. The network 204 may also be employed for communication between any two or more of the display module 140, the personal computer 200, the server 202, and the docking unit 208. In an embodiment of the present invention, data may be directly communicated between the display module 140 and the server 202 via the network 204, thus bypassing the personal computer 200 and the docking unit 208.

A variety of data may be communicated between any of the display module 140, the personal computer 200, the network 204, the server 202, and the docking unit 208. Such data may include, for example, performance parameters data, device settings (including display module 140 and sensor 200 setting), software, and firmware.

Communication among the various elements of the present invention may occur after the physical activity has been completed or in real time during the physical activity. In addition, the interaction between, for example, the display module 140 and the personal computer 200, and the interaction between the personal computer 200 and the server 202 may occur at different times.

Some of the display device 140 software and display device 140 and sensor 200 settings may relate to a zone-based system. In the zone-based system of the present invention, zones may be defined, for example, as ranges of percentages of an athlete's 102 maximum heart rate. Each zone may be associated with a particular color. An athlete's 102 maximum heart rate or speed may initially be provided to the display module 140, the personal computer 200, or the server 202 in a number of ways, as described below.

In one embodiment, the zones may be established based on a maximum user heart rate. An athlete's maximum heart rate can be provided to the display module 140 in a number of ways. If the athlete's 102 maximum heart rate is known, the athlete 102 may input the known maximum heart rate into the display module by, for example, actuating an input control 160. Alternatively, if the athlete's 102 maximum heart rate is not known, the athlete 102 may input their age into the display module by, for example, actuating an input control 160. In one embodiment, the user may enter both age and maximum heart rate information into the device. For example, when the device is turned on, the user 102 may press and hold the bottom button 162 of the display module 140 for five seconds. This may cause the word "age" to be displayed by the first display 148. The user 102 may then repeatedly press the top button 161 as numerical age values are incrementally displayed by the first display 148. When the user 102 reaches their age, they may press the bottom button 162 again causing the word "max" to be displayed by the first display 148. The user 102 may then repeatedly press the top button 161 as numerical maximum heart rate values, if known, are incrementally displayed by the first display 148. When the user 102 reaches their known maximum heart rate value, they may press the bottom button 162 to end the sequence. If the user 102 does no know their maximum heart rate value, they may press the bottom button 162 to bypass maximum heart rate entry.

In this case, the maximum heart rate can then be estimated based on one of many known formulas. According to one such formula, the athlete's 102 maximum heart rate is estimated to be two hundred and twenty minus the athlete's 102 age or:

$$HR_{MAX}=220-AGE$$

According to this formula, a thirty five year old athlete 102 would have an estimated maximum heart rate of 185 beats per minute. According to other formulas, other factors such as, for example, a user's height, weight, or gender may also be input to the display module 140 to determine an estimated maximum heart rate.

In an embodiment of the present invention, the maximum heart rate, age, or other information could be input the display module 140 via a remote computer.

In yet another embodiment, the athlete's 102 maximum heart rate may be determined by having the athlete 102 complete an assessment exercise. The athlete 102 could be prompted to, for example, run as fast as possible for 2 minutes. The display device would then be capable of measuring or estimating the athletes maximum heart rate based on the actual heart rates detected during the assessment exercise. In an embodiment, the user 102 could press and hold down the bottom button 162 of the display module 140 until the characters "ar" displayed by the first display 148, representing "assessment run." The user 102 may then press the top button 161 to initiate the assessment run. A numerical indication displayed on the first display 148 may count down from, for example, 120 seconds while the user is intensely exerting themselves during the assessment run. During the first assessment run, the display module 140 may store the highest heart rate achieved by the athlete 102 during the run into memory 158 as that athlete's maximum heart rate value. During subsequent assessment runs, the display module 140 may only update the maximum heart rate value stored in the memory 158 if the athlete's 102 maximum heart rate during the subsequent assessment run exceeds the value stored in the memory 158.

FIG. 11 is an exemplary illustration of zone definitions based on maximum heart rate for one embodiment of the present invention. An energy zone, ranging from 65% to 75% of an athlete's 102 maximum heart rate, may be associated with the color blue. An endurance zone, ranging from 75% to 85% of an athlete's 102 maximum heart rate, may be associated with the color green. A strength zone, ranging from 85% to 90% of an athlete's 102 maximum heart rate, may be associated with the color yellow. Finally, a power zone, ranging from 90% to 95% of an athlete's 102 maximum heart rate, may be associated with the color red. These ranges and color combinations are exemplary only; numerous other ranges and/or colors could be used.

The zones may be assigned based on predetermined fitness goals. For example, the energy zone (blue) may be associated with a heart rate range that allows an athlete 102 to build their aerobic base. The endurance zone (green) may be associated with a heart rate range that allows an athlete 102 to build cardiovascular strength and burn calories. The strength zone (yellow) may be associated with a heart rate range that allows an athlete 102 to improve their aerobic threshold and endurance. The power zone (red) may be associated with a heart rate range that allows an athlete 102 to improve their anaerobic threshold and metabolism.

Operation of the portable fitness monitoring system 100 according to an embodiment of the present invention will now be described. While the accompanying description is primarily directed towards embodiments wherein the sensor 180 is a heart rate sensor 182, those of skilled in the art will readily recognize that a variety of performance parameter sensors 180 may be used.

Before the athlete 102 begins a physical activity, the athlete 102 secures the heart rate sensor 182 to his chest. The athlete also releasably combines the display module 140 and the strap 112, as described above with respect to FIG. 7, and activates the display module 140 by using a user input control 160. Optionally, the athlete 102 may also use an input control 160 to select their desired visual output. At this time, the display module 140 may identify and begin to communicate with the heart rate sensor 182 via a WPAN to initiate the transmission of heart rate data from the heart rate sensor 182 to display module 140. As the athlete 102 engages in physical activity, the heart rate receiver 166 receives heart rate data from the heart rate sensor 182.

In an embodiment, the athlete 102 may not need to utilize an input control 160 to activate the display module 140 if the display module is already in a low-power, standby, or "sleep" mode. The display module 140 may automatically activate in response to receiving performance parameter data from a sensor 800. Accordingly, the display module 140 may provide a "soft" power-on, which may allow for quicker and/or more efficient start ups. The soft power-on may occur in response to the display module 140 periodically searching for data transmissions from the sensor 180.

When heart rate data is continuously transmitted to the portable fitness monitor in real time, the processor 156 may process this data in accordance with a program stored in the memory 158 embodying the zone-based system. For example if a heart rate based zone system is employed and a user's 102 maximum heart rate has been input into the memory 158, performance feedback may be provided to the athlete in real time via the visual displays 148 and 150. For example, if the athlete 102 is exercising with a heart rate that the processor 156 determines is 80% of the athlete's 102 maximum heart rate, the second display 150 may illuminate a light emitting sources with the color green, corresponding to the endurance zone. An illuminated second display 150 is illustrated in FIG. 12A.

In one embodiment, the color emitted by the second display 150 that corresponds to a particular heart rate zone may change in character in response to changes in the measured heart rate occurring within the zone. For example, the green light emitted may change in character in response to a measured heart rate increasing from a level near the bottom of the green zone to a heart rate level near the top of the green zone. The change in character may be, for example, a change in brightness or intensity. In an embodiment, the green light may change from a relatively light or dim light to a relatively dark or intense green as a user's 102 measured heart rate climbs upward through the green zone.

Performance feedback may be provided to the athlete 102 in real time via the displays that is not tied to the zone-based system. For example, if the athlete 102 is exercising with a heart rate that the processor 156 determines is 80% of the athlete's 102 maximum heart rate, which may be the equivalent of, for example, one hundred and thirty four beats per minute, the first display 148 may display the number "134." The second display 150 may blink one or more light emitting sources at a rate that is proportional to the user's 102 heart rate (i.e. blink at a rate of 134 pulses per minute, or a rate proportional thereto). In one embodiment of the present invention, the blink rate of the second display 150 is ⅓ of the measured heart rate so that the differences in blink frequency are more easily visually discernable. FIG. 12A shows the second display 150 in its illuminated state (i.e. during a blink) and FIG. 12B shows the second display 150 in its darkened state (i.e. between blinks). In an embodiment, the first display 148 could blink at a rate that is proportional to the user's 102 heart rate.

FIG. 8 illustrates a few examples of possible alphanumerical displays generated by the first display 148. Numerical heart rate values displayed by the first display 148 may include, for example, instantaneous, average, and maximum heart rates. Other numerical information, such as current time, elapsed time, or date may also be displayed. Suitable programs and/or data signal processing algorithms programmed into the memory 158 may also enable the display module 140 to estimate the total number of calories burned during the physical activity. Various calorie estimating algorithms are known to those of skill in the art, including those disclosed in commonly owned U.S. Patent Application Pub. No. 2009/0047645, titled "Sports electronic training system, and applications thereof," the disclosure of which is incorporated herein in its entirety by reference thereto.

Text in the form of complete words or abbreviations may also be displayed, including text representing terms such as, for example, "heart rate," "average," "maximum," "calories," or "age." First display 148 may be a single alphanumerical display or may consist of several sub-display areas. In an embodiment, the first display 148 displays information on more than one row.

The display device 140 thus may provide a simple and intuitive way for an athlete 102 to observe information about his heart rate in real-time. In some embodiments, because of the arrangement of the input controls 160 and displays 148 and 150, the presence of these elements is not obvious when viewing the exterior of the device. Because the device of embodiments of the present invention can be configured in such a minimalist form, its reduced size, weight, complexity, and cost may provide advantages over known monitoring systems and devices.

As performance data, such as, for example, heart rate data, is transmitted to the display module 140, they may be stored in the memory 158 or transmitted to the server 202. When performance parameter data is continuously transmitted to the display module 140 in real time, they may also be transmitted to the server 202 in real time. The performance parameter data may be processed by the processor 156 prior to storage or transmission. In an embodiment, performance parameter data is pre-processed by the sensors 180 themselves.

After the athlete 102 finishes his physical activity, the athlete 102 may deactivate the display module 140 by using a user input control 160. Alternatively, the display module 140 may automatically deactivate in response to no longer receiving performance parameter data from the heart rate sensor 182. The display module 140 may initiate a low-power, standby, or "sleep" mode in which power to one or more components is reduced or turned off. In this manner, the display module 140 may provide a "soft" off, which may allow a quicker and/or more efficient start up when the display module 140 is subsequently re-activated. Upon initiation of the deactivation procedure, the display module 140 may further ensure that data files or other recordings are completely saved and not closed prematurely prior to deactivation. This may be desirable to avoid loss of recorded performance parameter data. Once the physical activity is complete, the athlete 102 may initiate wired or wireless transmission of any stored performance parameter data to the personal computer 200 and/or the server 202. Alternatively, the display module 140 or the computer 200 and/or server 202 may initiate the transmission of data. In an embodiment, transmission of performance parameter or other data from the display module 140 to the computer 200 and/or the server 202 may still occur even if the device is in a soft off, low-power state.

Data communicated to and stored by the personal computer 200 or the server 202 may be accessible to the athlete 102 at a later time. In the case of storage on the server 202, the athlete 102 could access post-activity performance data communicated to the server 202 from their display module 140 at a later time from their personal computer 200 over the network 202. In another embodiment of the present invention, a third party (e.g. a trainer, coach, friend, or family member) stationed at a personal computer 200 may be able to access real-time or historical performance information regarding the athlete's 102 performance via the server 202 over the network 204.

Figure 13:
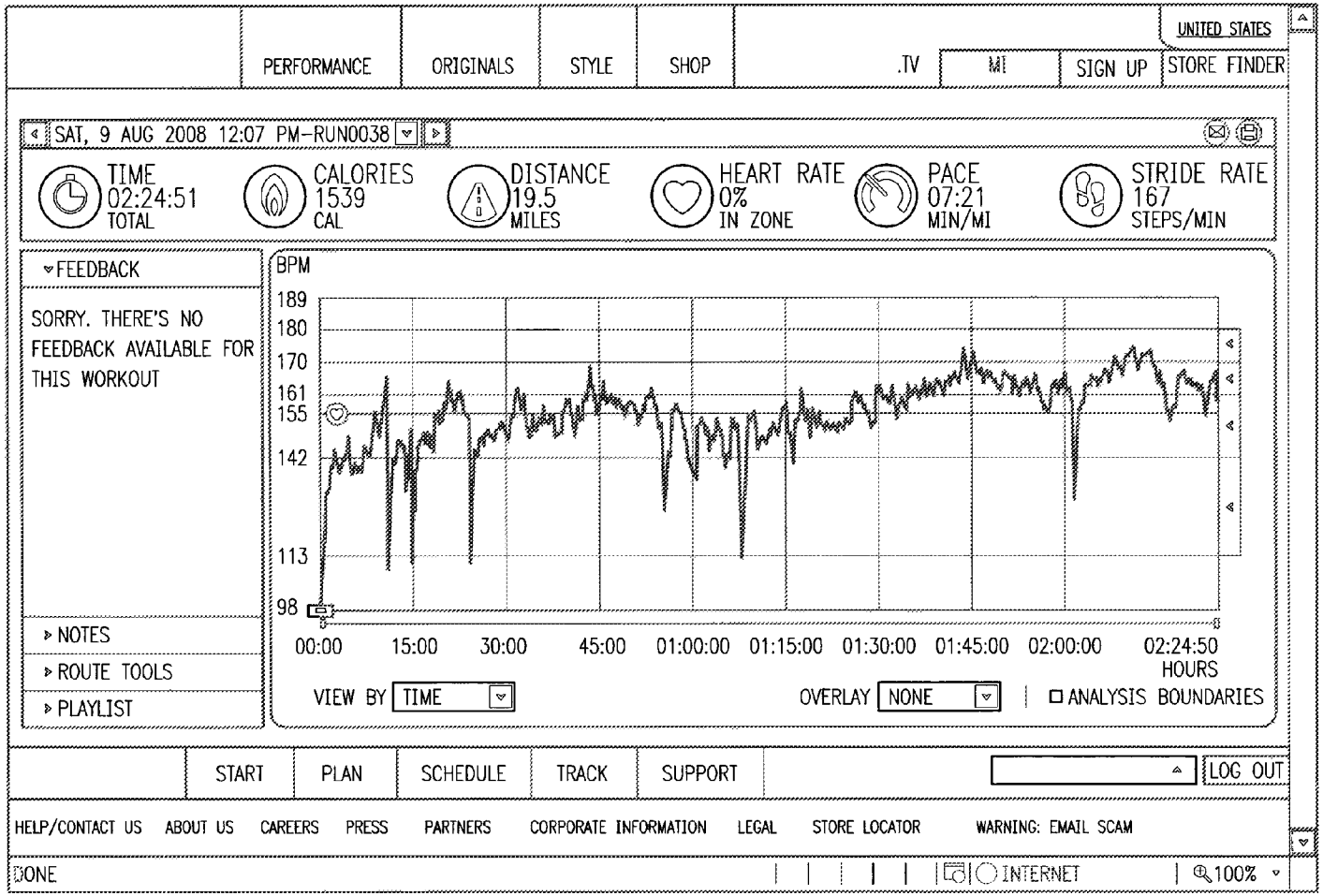
FIG. 13 is an illustration of a user interface according to an embodiment of the present invention.

The personal computer 200 and/or the server 202 may include software configured to includes a number of different modules capable of providing various fitness monitoring services to athletes 102. Each module may support one or more graphical user interfaces (GUIs) capable of being presented to users at personal computers 200. FIG. 13 is an exemplary illustration of a GUI window presented by a history software module showing a heart rate graph and other information derived from performance parameter data recorded during a single physical activity and transmitted from the display module 140 to a personal computer 200 and/or a server 202.

In embodiments of the present invention capable of interacting with a personal computer 200, any device settings of the display module or information capable of being input or altered via the input controls 160 may alternatively or additionally be input or altered via the computer 200.

In addition to storing application program instructions and saving recorded performance parameter data, the memory 158 of the display module 140 may also be used, for example, to store workout routines 210, as described in further detail below. The processor 156 may also be able of executing the workout routines 210.

The personal computer 200 and/or the server 202 may include software configured to include a plan module to select a default workout routine, create a custom workout, or even select or customize an entire training plan comprised of individual workouts. Workouts may be scheduled on a virtual calendar, or may be saved without being associated with a particular date. Workout and plan creation is discussed in more detail in co-pending U.S. patent application Ser. No. 12/468,025, filed May 18, 2009, now published as U.S. Patent App. Pub. No. 2010/0292600, filed on the same day herewith, which is incorporated by reference in its entirety.

The user 102 may be able to select or create a workout routine 210 including different time intervals of different intensities, according to the color coded zone-based system described above. A workout may include, for example, a 5 minute warm up in the blue zone, then a 10 minute jog in the green zone, followed by a 5 minute run in the yellow zone.

In one embodiment, after a workout routine 210 is created, it may be sent through wired or wireless transmission from the computer 200 or server 202 to the display module 140 via the computer input/output 164. One or more workout routines 210 may be received by the display module 140 and stored in the memory 158. The processor 156 may be capable of executing the workout routines 210.

Figure 14:
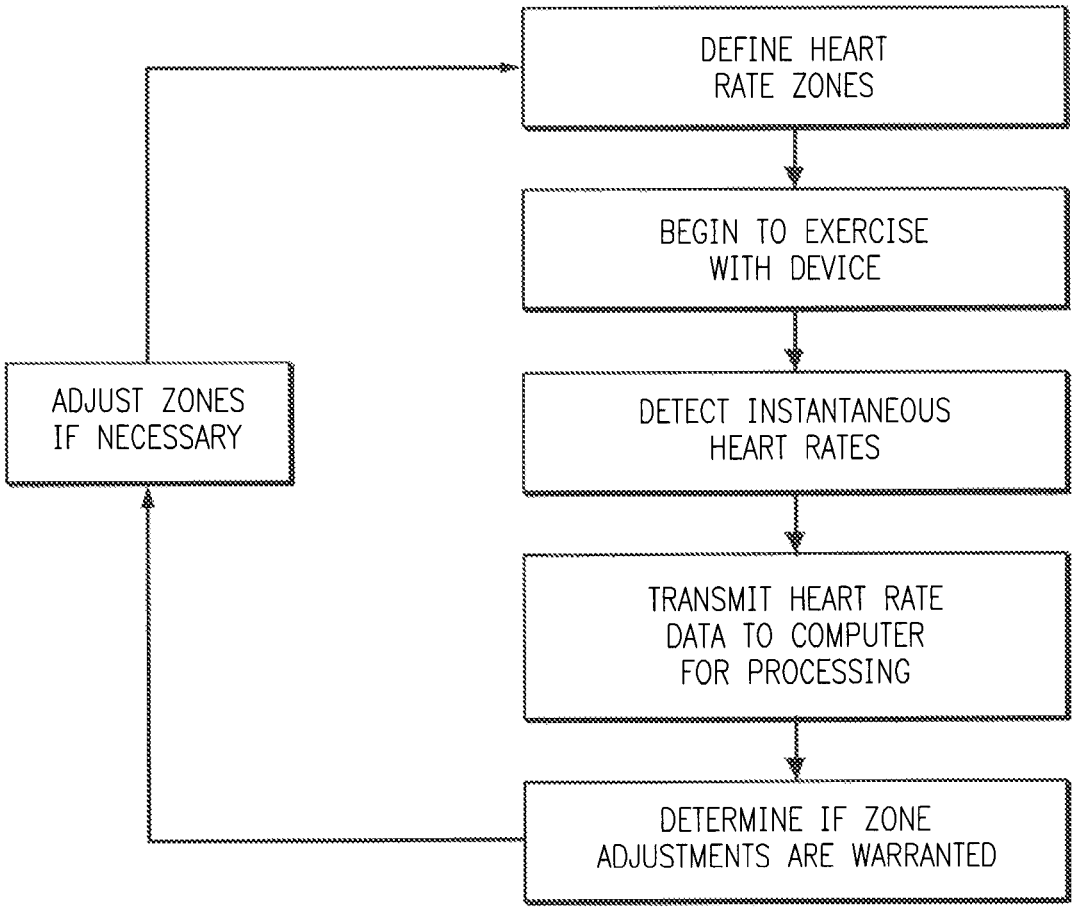
FIG. 14 is a flow chart illustrating heart rate zone adjustments according to an embodiment of the present invention.

In one embodiment, after the heart rate zones have been initially defined, the portable fitness monitoring system 100 may be adapted to selectively adjust the limits of the heart rate zones in response to the athlete's 102 performance and/or feedback received from the athlete, if such adjustments are warranted. In this manner, as illustrated in FIG. 14, the portable fitness monitoring system 100 may provide a training feedback loop. As described above, the zones may be defined based on user input (e.g. maximum heart rate, age, and/or another input parameter). User heart rate data is detected during a physical activity via the heart rate sensor 182, as described above. The heart rate data is transmitted to the computer 200 and/or the server 202 for processing. A determination is made as to whether the zones need to be adjusted. If adjustments are warranted, this data is communicated back to the display module 140.

The determination as to whether or not the zones need to be adjusted may be based on performance data (e.g., heart rate data) and/or feedback received from the athlete. With respect to performance data, factors may include, for example, the athlete's 102 consistency during a particular physical activity, their rate of recovery after the activity, or their performance during specific interval training sessions, as specified by a workout routine 210. For example, the athlete may use the fitness monitoring system 100 during workout routine 210 in which the intervals are based on maintaining a heart rate within a particular heart rate zone during the interval. If the athlete performs outside the specified heart rate zone for all or a portion of the interval, the heart rate zone may be adjusted. For example, if the athlete is consistently above the specified zone, the zone range may be increased. If the athlete is consistently below the specified zone, the zone range may be decreased.

Determinations may further be influenced by feedback provided by the athlete. For example, the athlete may provide responses to questions posed by the portable fitness monitoring system. For example, upon uploading recently recorded workout data, or upon logging in to the computer 200 and/or sever 202, a GUI pop-up window may appear asking the user 102, for example, if they thought the workout was too difficult or too easy. If the user responds that a workout was too difficult, the zone range may be incrementally decreased. If the user responds that a workout was too easy, the zone range may be incrementally increased.

In other embodiments, display module 140 may be capable of interacting with a portable fitness monitoring device 300. The portable fitness monitoring device 300 may be a device such as, for example, a mobile phone, a personal digital assistant, or a music file player (e.g. and MP3 player), a GPS-enabled device, exercise equipment, a dongle (e.g. a small hardware device that protects software), or a dedicated portable fitness training device, such as the device disclosed in an embodiment of commonly owned U.S. patent application Ser. No. 12/467,944, filed May 18, 2009, now U.S. Pat. No. 8,033,959, the disclosure of which is incorporated herein in its entirety by reference thereto.

In other embodiments, the display module 140 may be capable of storing and executing workout routines, such as those disclosed in an embodiment of commonly owned U.S. patent application Ser. No. 12/467,944, filed May 18, 2009, now U.S. Pat. No. 8,033,959, the disclosure of which is incorporated herein in its entirety by reference thereto.

Figure 15A:
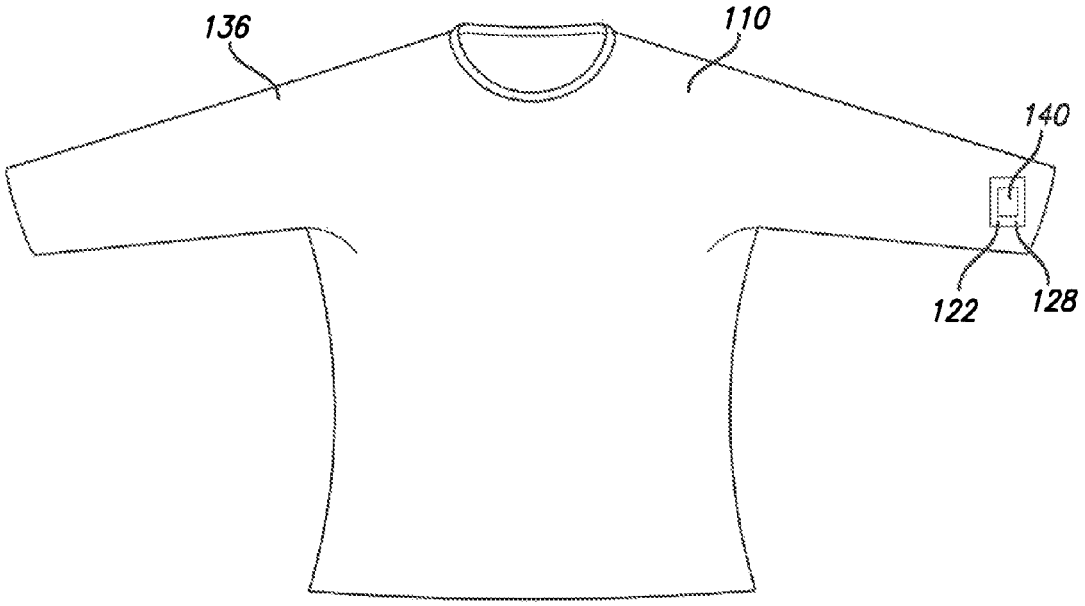
FIG. 15A is an illustration of a shirt according to an embodiment of the present invention.
Figure 15B:
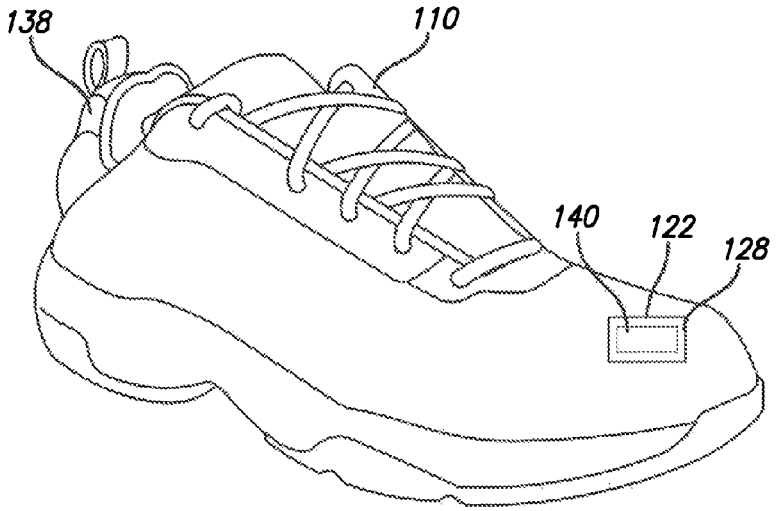
FIG. 15B is an illustration of a shoe according to an embodiment of the present invention.

As indicated above, in addition to being a strap 112, the article for wearing 110 may be, for example, a band, a glove, a hat, a jacket, a shirt, a pair of pants, a sports bra, an article of footwear, a piece of eyewear, a ring, or any other article capable of being worn by an athlete 102. FIG. 15A shows a display module 140 releasably attached to a long sleeved performance t-shirt 136, while FIG. 15B shows a display module 140 releasably attached to an athletic shoe 138. In the embodiments of FIGS. 15A and 15B, the display module 140 is releasably secured in a cavity 122 in the article for wearing 110 (i.e. shirt 136 and shoe 138, respectively), and the article for wearing 110 is provided with a window 128. In an embodiment, the cavity 122 could be a pocket or pouch.

In another embodiment of the present invention, instead of being releasably secured to an article for wearing 110, the display module 140 could be secured to a piece of exercise equipment, including, but not limited to, a bicycle.

In a further embodiment, the display 140 module may be permanently fixed to or integrally formed with the article for wearing 110, as opposed to being releasably secured to it.

Some of the display modules 140 and various sensors 180 of the monitoring system 100 have been described above as being able to communicate over a network using one or more wireless protocols including, but not limited to, ANT+. In an embodiment, the display module 140 may further be able to communicate over a network using a wireless protocol with other devices including, but not limited to, foot pods, pedometers, inclinometers, treadmills, bicycles, power meters, cadence sensors, speed sensors, distance sensors, scales, body mass index scales, respiration sensors, global positioning service (GPS) devices, and altimeters.

As indicated above, in some embodiments, the display module 140 may be capable of storing and executing workout routines, such as those disclosed in an embodiment of commonly owned U.S. patent application Ser. No. 12/467, 944, filed May 18, 2009, now U.S. Pat. No. 8,033,959, the disclosure of which is incorporated herein in its entirety by reference thereto.

The athlete 102 may engage in physical activity while being guided in accordance with the workout routine, as the heart rate receiver 166 receives the performance parameter data. The workout routine may include different time intervals of different intensities, according to the color-coded zone-based system described above. Accordingly, the second display 150 could provide the athlete 102 with an indication about which zone they are in, while another color display could provide the athlete 102 with an indication about which zone they should be in, based on the workout routine.

In an embodiment, the display module 140 may include a speaker for providing audible output to the athlete 102 related to the workout routine. The display module 140 may include means for vibrating the module 140, such as, for example, a piezoelectric actuator, for providing sensory output to the athlete 102. This sensory output could indicate to the athlete 102 that they should look at the display module 140 to receive color-coded or other information about their performance and/or workout routine.

Embodiments of the present invention may employ an inductive charger for charging a battery that provides power to the device. As is known by those of skill in the art, inductive charging charges electrical batteries using electromagnetic induction. Induction chargers typically use an induction coil to create an alternating electromagnetic field from within a charging base station, and a second induction coil in the portable device takes power from the electromagnetic field and converts it back into electrical current to charge the battery. The two induction coils in proximity combine to form an electrical transformer.

A charging station may send energy through inductive coupling to an electrical device, which stores the energy in a battery. Because there is a small gap between the two coils, inductive charging is a kind of short-distance wireless energy transfer. This differs from standard conductive charging, which requires direct wired contact between the battery and the charger. Conductive charging is normally achieved by connecting a device to a power source with plug-in wires. In embodiments where the display module 140 can wirelessly communicate data with a computer 200 and/or server 202, the display module 140 may also be adapted to wirelessly recharge via inductive charging. In an embodiment, an inductive charging post, receptacle, station, or any other sort of structure may be provided so that inductive charging and wireless transfer and/or reception can occur simultaneously at the same location. This advantageously may allow the display module 140 to be fabricated without any power outlets or removable battery closure lids.

In an embodiment of the present invention, fiber optic channels in the article for wearing 110, such as the strap 112, could allow the entire article for wearing 110, or a substantial portion thereof, to glow from light output by the second display 150.

While many of the exemplary embodiments discussed above make reference to a color-coded heart rate zone-based system, color-coded zone systems based on zones of other parameters including, but not limited to, speed, pace, stride rate, calories, respiration rate, blood oxygen level, blood flow, hydration status, or body temperature may also be employed. The present invention is therefore not to be limited to only heart rate based zone systems.

Furthermore, while many of the exemplary embodiments discussed above make reference to a color-coded heart rate zone-based system where the zones may be defined as ranges of percentages of an athlete's 102 maximum heart rate, heart rate zones may be defined based on other parameters as well.

In one embodiment, heart rate zones may be defined as ranges of percentages of an athlete's 102 maximum heart rate. In another embodiment, heart rate zones may be defined as ranges derived from parameters such as an athlete's 102 ventilation threshold heart rate. In a further embodiment, heart rate zones may be defined as ranges derived from both the athlete's 102 peak heart rate and the athlete's 102 ventilation threshold heart rate.

An athlete's 102 peak heart rate may or may not be the same as the athlete's 102 maximum heart rate. As used herein, "peak heart rate" refers to the highest heart rate that a particular athlete 102 can achieve during a training session. The athlete's physiologically possible maximum heart rate may be higher that the peak heart rate. For some athletes 102, typically those in top physical condition, their peak heart rate may be very close to their max heart rate. For other athletes 102, typically those who are less well conditioned, their peak heart rate may be far less than their true physiologically possible max heart rate. Accordingly, in an embodiment, an athlete 102 may enter their peak heart rate into their display module 140 or save this information on the server 202. The athlete 102 may also be able to capture peak heart rate information during an assessment run, as described in further detail above.

As an exercise progressively increases in intensity, the air into and out of your respiratory tract (called ventilation) increases linearly or similarly. As the intensity of exercise continues to increase, there becomes a point at which ventilation starts to increase in a non-linear fashion. This point where ventilation deviates from the progressive linear increase is called the "ventilation threshold." The ventilation threshold is closely related to the lactate threshold, or the point during intense exercise at which there is an abrupt increase in blood lactate levels. Research suggests that the ventilation and lactate thresholds may be some of the best and most consistent predictors of performance in endurance events. The athlete's 102 heart rate at the ventilation threshold point may be referred to as their ventilation threshold heart rate. Accordingly, in an embodiment, an athlete 102 may enter their ventilation threshold heart rate into their display module 140 or save this information on the server 202. The athlete 102 may also be able to capture ventilation threshold heart rate information during an assessment run, as described in further detail above, by using equipment necessary for determining ventilation and/or lactate threshold.

In an embodiment, the heart rate zones may be defined as ranges derived from both the athlete's 102 peak heart rate and the athlete's 102 ventilation threshold heart rate. For example, Table 1 illustrates an exemplary embodiment in which color-coded heart rate zones may be defined for an athlete 102 with a peak heart rate (PHR) of 200 beats per minute and a ventilation threshold heart rate (VTHR) of 170 beats per minute:

TABLE 1

| ZONE BOUNDARY | CALCULATION | HR VALUE | % MAX HR |
|---|---|---|---|
| Upper Red Zone Limit (URZ) | =PHR | 200 | 93.5% |
| Lower Red Zone Limit (LRZ) | =%110 of VTHR | 187 | 87.4% |

TABLE 1-continued

| ZONE BOUNDARY | CALCULATION | HR VALUE | % MAX HR |
|---|---|---|---|
| Upper Yellow Zone Limit (UYZ) | =LRZ − 1 | 186 | 87.0% |
| Lower Yellow Zone Limit (LYZ) | =VTHR | 170 | 79.5% |
| Upper Green Zone Limit (UGZ) | =LYZ − 1 | 169 | 79.0% |
| Lower Green Zone Limit (LGZ) | =UBZ + 1 | 154 | 72.0% |
| Upper Blue Zone Limit (UBZ) | =90% of VTHR | 153 | 71.5% |
| Lower Blue Zone Limit (LBZ) | =80% of VTHR | 135 | 63.1% |

As illustrated by Table 1, each color coded zone may be defined as having upper and lower limits. Each zone limit may be calculated based on PHR, VTHR, and/or one of the other zone limits. A heart rate value associated with each zone limit may be correlated to a percentage of max heart rate if max heart rate is known or can be estimated. In an embodiment, PHR is assumed to be 93.5% of an athlete's 100 max heart rate value. Accordingly, physical activities may be carried out and content may be presented via GUIs according to the color-coded heart rate zone based system of the present invention.

As described above, color-coded pace or speed based systems may also be employed. In an embodiment, upper and lower pace or speed zone limits may be derived in part from PHR and VTHR values. For example, an athlete may conduct one or more physical activities using a heart rate monitor, a ventilation threshold (or lactate threshold) monitor, and/or pace or speed monitors. Measurements may be conducted by portable monitors, stationary monitors, or in a laboratory after the physical activities are conducted. A relationship between the pace or speed of the athlete and max heart rate, PHR, and/or VTHR may be established. Accordingly, color-coded pace or speed zone limits may be determined based on this information.

In another embodiment of the present invention, zones may be determined based on a measurement of power. Power measurements may be derived from pace calculations if other parameters such as, for example, the athlete's 102 body weight and the incline of the surface traversed (e.g. incline of a sidewalk, bike path, or treadmill surface).

The present invention has been described above by way of exemplary embodiments. Accordingly, the present invention should not be limited by any of the above-described exemplary embodiments, but should be defined only in accordance with the following claims and their equivalences.

What is claimed is:

1. A method of providing performance feedback to an individual using a portable fitness monitoring device, the method comprising:

sensing performance parameter information during the physical activity;

generating a first visual output that includes an indication of the intensity level that the individual should be performing at; and generating a second visual output that includes an indication of the intensity level that the individual is currently performing at, wherein the first visual output further includes a color previously associated with the intensity level that the individual should be performing at, and wherein the second visual output further includes a color previously associated with the intensity level that the individual is currently performing at.

2. The method of claim 1, further comprising displaying the first visual output and the second visual output at the same time.

3. The method of claim 1, further comprising prompting the individual to look at the display.

4. The method of claim 3, wherein the prompting comprises vibrating the portable fitness monitoring device.

5. The method of claim 4, wherein the vibrating is provided via a piezoelectric actuator of the portable fitness monitoring device.

6. The method of claim 1, wherein the sensing further comprises sensing heart rate via a heart rate sensor of the portable fitness monitoring device.

7. The method of claim 1, wherein the sensing further comprises sensing speed or pace via an accelerometer of the portable fitness monitoring device.

8. The method of claim 1, wherein the sensing further comprises sensing speed or pace via a GPS receiver of the portable fitness monitoring device.

9. The method of claim 1, further comprising presenting the first visual output and the second visual output to the individual via a touch screen display of the portable fitness monitoring device during the physical activity.

10. The method of claim 9, further comprising receiving a touch input from the individual via the touch screen display during the physical activity.

11. The method of claim 10, further comprising influencing at least one characteristic of one of the first visual output or the second visual output in response receiving of the touch input.

12. The method of claim 1, further comprising storing the performance parameter information in a memory of the portable fitness monitoring device for later transmission to a separate device.

13. The method of claim 1, further comprising sending data to a separate device via a wireless transceiver of the portable fitness monitoring device.

14. The method of claim 13, further comprising sending audio performance feedback data to wireless headphones via the wireless transceiver.

15. The method of claim 13, further comprising sending music data to wireless headphones via the wireless transceiver.

16. A method of providing performance feedback to an individual using a portable fitness monitoring device, the method comprising:

sensing performance parameter information during the physical activity;

generating a first output that includes an indication of the intensity level that the individual should be performing at; and generating a second output that includes an indication of the intensity level that the individual is currently performing at, wherein the sensing further comprises sensing speed or pace via a GPS receiver of the portable fitness monitoring device.

17. The method of claim 16, wherein the first output further includes an indication of a color previously associated with the intensity level that the individual should be performing at.

18. The method of claim 16, wherein the second output further includes an indication of a color previously associated with the intensity level that the individual is currently performing at.

19. The method of claim 16, further comprising delivering the first output and the second output at different times.

20. The method of claim 16, wherein the sensing further comprises sensing heart rate via a heart rate sensor of the portable fitness monitoring device.

21. The method of claim 16, wherein the sensing further comprises sensing speed or pace via an accelerometer of the portable fitness monitoring device.

22. The method of claim 16, further comprising receiving a touch input from the individual via a touch screen display during the physical activity.

23. The method of claim 22, further comprising influencing at least one characteristic of one of the first output or the second output in response to receiving the touch input.

24. A method of providing performance feedback to an individual using a portable fitness monitoring device, the method comprising:

sensing performance parameter information during the physical activity;

generating a first visual output that includes an indication of the intensity level that the individual should be performing at;

generating a second visual output that includes an indication of the intensity level that the individual is currently performing at; and changing the second visual output in response to a change in the intensity level that the individual is currently performing at.

25. The method of claim 24, wherein the second visual output further includes a color previously associated with the intensity level that the individual is currently performing at.

26. The method of claim 24, wherein changing the second visual output includes changing an intensity of the second visual output.

27. The method of claim 24, wherein changing the second visual output includes changing a brightness of the second visual output.

* * * * *